US011583977B2

(12) United States Patent
Martin et al.

(10) Patent No.: US 11,583,977 B2
(45) Date of Patent: Feb. 21, 2023

(54) ABRASIVE ARTICLES HAVING A PLURALITY OF PORTIONS AND METHODS FOR FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Amandine Martin, Lyons (FR); Joachim Schwarzkopf, Geesthacht (DE); Peter Janeczek, Finnentrop (DE); Flavy Bayard, Tours (FR)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 70 days.

(21) Appl. No.: 17/344,286

(22) Filed: Jun. 10, 2021

(65) Prior Publication Data

US 2021/0299818 A1 Sep. 30, 2021

Related U.S. Application Data

(63) Continuation of application No. 16/331,836, filed as application No. PCT/US2017/050743 on Sep. 8, 2017, now Pat. No. 11,059,148.

(Continued)

(51) Int. Cl.

*B24D 5/02* (2006.01)
*B24D 3/14* (2006.01)

(Continued)

(52) U.S. Cl.

CPC ..... *B24D 5/02* (2013.01); *B24D 3/14* (2013.01); *B24D 3/28* (2013.01); *B24D 5/14* (2013.01); *B24D 7/14* (2013.01)

(58) Field of Classification Search

CPC ... B24D 5/02; B24D 3/14; B24D 3/28; B24D 5/14; B24D 7/14

See application file for complete search history.

(56) References Cited

U.S. PATENT DOCUMENTS 3,868,233 A ‡ 2/1975 Carver ..... B24D 3/001 51/298
5,695,394 A ‡ 12/1997 Buffat ..... B24D 3/28 451/546

(Continued)

FOREIGN PATENT DOCUMENTS

CN 1284021 A 2/2001
CN 1284021 A ‡ 2/2001 ..... B24D 5/04

(Continued)

OTHER PUBLICATIONS

International Search Report and Written Opinion for PCT/US2017/050743, dated Dec. 22, 2017, 15 pages.‡

*Primary Examiner* — Pegah Parvini
(74) *Attorney, Agent, or Firm* — Abel Schillinger, LLP; Joseph P. Sullivan

(57) ABSTRACT

An abrasive article can include a body including a plurality of portions including a first abrasive portion and a second abrasive portion. The first abrasive portion can include a vitreous bond material and abrasive particles contained within the bond material. The second abrasive particles can include an organic bond material and abrasive particles contained within the bond material. The body can have a burst speed of at least 65 m/s. In an embodiment, the abrasive article can include an interior portion coupled to the first and second abrasive portions. In another embodiment, the interior portion can optionally include abrasive particles or a filler material.

20 Claims, 7 Drawing Sheets

Related U.S. Application Data

(60) Provisional application No. 62/385,705, filed on Sep. 9, 2016.

(51) Int. Cl.

| | |
|---|---|
| ***B24D 3/28*** | (2006.01) |
| ***B24D 5/14*** | (2006.01) |
| ***B24D 7/14*** | (2006.01) |

(56) References Cited

U.S. PATENT DOCUMENTS

| | | | | | |
|---|---|---|---|---|---|
| 6,074,278 | A ‡ | 6/2000 | Wu | B24D 5/04 | 451/28 |
| 6,796,891 | B2 ‡ | 9/2004 | Terada | B24D 3/28 | 451/541 |
| 6,840,850 | B2 ‡ | 1/2005 | Bancon | B24D 5/12 | 451/544 |
| 8,029,338 | B2 ‡ | 10/2011 | Kumar | B24D 5/00 | 451/49 |
| 8,357,028 | B2 ‡ | 1/2013 | Jeevanantham | B24B 1/00 | 451/59 |
| 2002/0119742 | A1 ‡ | 8/2002 | Nakagawa | B24D 5/06 | 451/542 |
| 2012/0100784 | A1 ‡ | 4/2012 | Klett | B24D 11/00 | 451/41 |
| 2014/0256238 | A1 ‡ | 9/2014 | Van | B24D 3/20 | 451/548 |
| 2014/0287658 | A1 ‡ | 9/2014 | Flaschberger | B24D 3/14 | 451/47 |
| 2015/0000206 | A1 ‡ | 1/2015 | Klett | B24D 11/02 | 51/298 |
| 2015/0251294 | A1 ‡ | 9/2015 | Nie | B24D 3/32 | 451/544 |
| 2016/0263728 | A1 * | 9/2016 | Umetsu | B28B 11/243 | |

FOREIGN PATENT DOCUMENTS

| | | | | |
|---|---|---|---|---|
| CN | 1372503 | A | 10/2002 | |
| CN | 1372503 | A ‡ | 10/2002 | B24D 7/16 |
| CN | 1486232 | A | 3/2004 | |
| CN | 1486232 | A ‡ | 3/2004 | |
| CN | 103372817 | A | 10/2013 | |
| EP | 0344610 | A2 | 12/1989 | |
| EP | 0344610 | A2 ‡ | 12/1989 | B24B 5/045 |
| EP | 0945221 | A2 | 9/1999 | |
| FR | 2803786 | A1 ‡ | 7/2001 | B24D 5/12 |
| FR | 2803786 | B1 | 3/2002 | |
| JP | S6288574 | A ‡ | 4/1987 | |
| JP | S6288574 | A | 4/1987 | |
| JP | S6288579 | A | 4/1987 | |
| JP | S6288579 | A ‡ | 4/1987 | |
| KR | 20120111511 | A | 10/2012 | |
| KR | 20120111511 | A ‡ | 10/2012 | |
| WO | 99/038648 | A1 | 8/1999 | |
| WO | WO-99/38648 | A1 ‡ | 8/1999 | B24D 5/04 |
| WO | 01/008849 | A1 | 2/2001 | |
| WO | WO-01/008849 | A1 ‡ | 2/2001 | |
| WO | 01/53041 | A1 | 7/2001 | |
| WO | 02/45908 | A1 | 6/2002 | |
| WO | WO-02/45908 | A1 ‡ | 6/2002 | B24D 7/10 |
| WO | 2011/109188 | A2 | 9/2011 | |
| WO | WO-2011/109188 | A2 ‡ | 9/2011 | C04B 35/1115 |

* cited by examiner
‡ imported from a related application

ABRASIVE ARTICLES HAVING A PLURALITY OF PORTIONS AND METHODS FOR FORMING SAME

CROSS-REFERENCE TO RELATED APPLICATIONS

This application is a continuation application of and claims priority under 35 U.S.C. § 120 to U.S. patent application Ser. No. 16/331,836 entitled "ABRASIVE ARTICLES HAVING A PLURALITY OF PORTIONS AND METHODS FOR FORMING SAME," by Amandine MARTIN, Joachim SCHWARZKOPF, Peter JANECZEK, and Flavy BAYARD, filed Mar. 8, 2019, which is the National Stage of International Application No. PCT/US2017/050743, entitled "ABRASIVE ARTICLES HAVING A PLURALITY OF PORTIONS AND METHODS FOR FORMING SAME", by Amandine MARTIN, Joachim SCHWARZKOPF, Peter JANECZEK, and Flavy BAYARD, filed Sep. 8, 2017, which claims priority under 35 U.S.C. § 119(e) to U.S. Patent Application No. 62/385,705, entitled "ABRASIVE ARTICLES HAVING A PLURALITY OF PORTIONS AND METHODS FOR FORMING SAME", by Amandine MARTIN, Joachim SCHWARZKOPF, Peter JANECZEK, and Flavy BAYARD, filed Sep. 9, 2016, all of which are assigned to the current assignee hereof and incorporated herein by reference in their entireties.

FIELD OF THE DISCLOSURE

The present invention relates in general to abrasive articles, in particular, to abrasive articles having a plurality of portions and methods of forming the same.

DESCRIPTION OF THE RELATED ART

Abrasive articles used in machining applications typically include bonded abrasive articles and coated abrasive articles. A bonded abrasive article generally has a bond matrix containing abrasive particles. Bonded abrasive articles can be mounted onto a suitable machining apparatus and used in various applications, such as shaping, grinding, polishing, and cutting. The industry continues to demand improved abrasive tools to meet needs of gear grinding.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
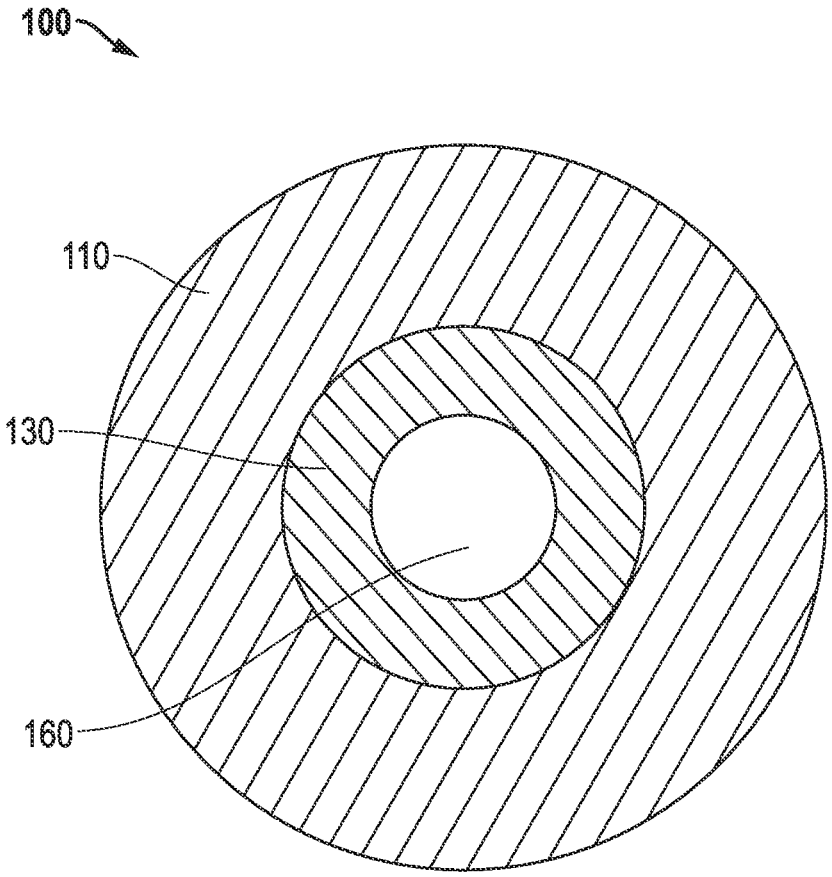
FIG. 1 includes an illustration of a side view of an abrasive article in accordance with an embodiment.

The following is generally directed to bonded abrasive articles suitable for use in material removal operations. The bonded abrasive articles can be used in various applications, including for example, surface grinding, precision grinding operations (e.g., gear grinding operations), and the like.

Reference herein to bonded abrasive articles includes reference to a three dimensional volume of an abrasive material having abrasive particles contained within a volume of a bond material. Bonded abrasive articles can be distinct from coated abrasive articles that may utilize a single layer of abrasive particles contained in a layer of bond or adhesive material. Moreover, the bonded abrasive articles of embodiments herein may include some porosity within the three-dimensional volume of a bond material.

Certain embodiments herein are directed to an abrasive article having a body that may include a plurality of portions, such as a first abrasive portion and a second abrasive portion. The portions may differ from each other in composition of one or more components (e.g., bond material, abrasive particle type or shape, filler materials, etc.), shape, their relative positions within the body, size, abrasive capabilities, and the like. For example, in at least one aspect, the body includes first and second abrasive portions which are distinct from each other in at least one aspect and configured to conduct different abrasive removal operations, including for example, a coarse grinding operation and a fine grinding operation. For instance, the abrasive article may be particularly suitable for gear grinding, which often demands both fast removal rates and generation of precise surface features.

In a further embodiment, the abrasive article can include an interior portion that can be distinct from the first and second abrasive portions. The interior portion can include a bond material, abrasive particles, a filler, or any combination thereof. Notably, the abrasive article may have a particular combination of first abrasive portion, second abrasive portion, and interior portion that facilitates use of the abrasive article in applications having rigorous burst speed requirements.

Other aspects herein are related to methods of forming an abrasive article. In an embodiment, a method can include coupling a first abrasive portion and a second abrasive portion. The first abrasive portion and the second abrasive portion may be formed separately and then coupled. Alternatively, the first abrasive portion can be formed beforehand and coupled to the second abrasive portion during formation of the second abrasive portion. In another embodiment, a method can include coupling an interior portion to the first abrasive portion, the second abrasive portion, or both.

In an embodiment, the abrasive article can include a body including a plurality of portions. In a particular embodiment, the body can have an average burst speed of at least 65 m/s to allow the abrasive article to be suitable for applications requiring a higher grinding speed. For example, the body can have an average burst speed of at least 70 m/s, such as at least 75 m/s or at least 80 m/s or at least 85 m/s or at least 90 m/s or at least 95 m/s or at least 100 m/s or at least 110 m/s or at least 120 m/s or at least 130 m/s or at least 140 m/s or at least 150 m/s or at least 160 m/s or at least 170 m/s or at least 180 m/s. In another embodiment, the body may have a burst speed of not greater than 200 m/s or not greater than 180 m/s or not greater than 150 m/s. In a further embodiment, the abrasive article can include a body that has an average speed within a range including any of the minimum and maximum values disclosed herein. For instance, the body can have an average burst speed in a range of at least 70 m/s and not greater than 200 m/s, such as in a range of at least 80 m/s and not greater than 180 m/s. Burst speed, as used herein, refers to the speed limit an abrasive article can reach prior to failure and is used to validate the maximum operational speed permitted by the Organization for the Safety of Abrasives for using the abrasive article. Burst speed is measured using the method published by Organization for the Safety of Abrasives, which can be found at http://www.osa-abrasives.org/, and in accordance with EN 12413. The maximum operational speed of an abrasive article may vary between countries, but can be converted from the burst speed following EN 12413. For example, in Europe (EU), conversion can be performed in accordance with EU ISO EN12413. In EU, for an open machine operation, the burst speed of an abrasive article is √3 times the maximum operational speed; for a closed machine operation, the bust speed of an abrasive article is √1.75 times the maximum operational speed.

In one embodiment, the body can include a first abrasive portion. The first abrasive portion can include abrasive particles contained within a bond material. In a particular embodiment, the first abrasive portion can include abrasive particles contained within the bonded matrix of the bond material. The bond material can include an inorganic material. An exemplary inorganic material can include a ceramic, a vitreous material, or a combination thereof. A ceramic material can include a single crystalline phase, a polycrystalline phase, an amorphous phase, or any combination thereof. A vitreous material can have an amorphous phase. In a particular embodiment, the first abrasive portion can include the bond material including a vitreous material. In another embodiment, the bond material may include a non-vitreous material. The non-vitreous material can include a polycrystalline phase. In yet another embodiment, the bond material can include a mixture of polycrystalline and vitreous material. In at least one embodiment, the entirety of the bond material of the first abrasive portion can consist essentially of a vitreous material.

In a further embodiment, the inorganic material can include an oxide, a carbide, a nitride, a boride, or any combination thereof. An exemplary oxide can include a metalloid element (e.g., Si), an alkali metal element, an alkaline earth metal element, a lanthanoid, a transition metal element, or any combination thereof. In a particular embodiment, the bond material can include boron oxide ($B_2O_3$), silicon oxide ($SiO_2$), aluminum oxide ($Al_2O_3$), calcium oxide (CaO), magnesium oxide (MgO), barium oxide (BaO), strontium oxide (SrO), lithium oxide ($Li_2O$), sodium oxide ($Na_2O$), potassium oxide ($K_2O$), cesium oxide ($Cs_2O$), phosphorous oxide ($P_2O_5$), zircon, or any combination therefor.

In an embodiment, the first abrasive portion can include a certain content of the bond material to facilitate formation of the first abrasive portion. For example, the content of the bond material for a total volume of the first abrasive portion can be at least 2 vol %, such as at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol %. In another non-limiting embodiment, the first abrasive portion may include not greater than 60 vol % bond material for the total volume of the first abrasive portion, such as not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %. In a further embodiment, the first abrasive portion can include a content of the bond material within a range including any of the minimum to maximum percentages noted above. For example, the content of the bond material can be within a range of 2 vol % to 60 vol %, such as within a range of 10 vol % to 30 vol %.

In an embodiment, the abrasive particles of the first abrasive portion include at least one material selected from the group of carbides, nitrides, borides, oxides, superabrasives, or any combination thereof. In a further embodiment, at least a portion of the abrasive particles of the first abrasive portion can include shaped abrasive particles. In another embodiment, the abrasive particles of the first abrasive portion can include a blend of different types of abrasive particles including shaped abrasive particles and non-shaped abrasive particle. In a particular embodiment, the abrasive particles of the first abrasive portion can include alumina.

In another embodiment, abrasive particles can be present in the first abrasive portion in a certain content to facilitate improved formation and properties of the abrasive article. For example, the first abrasive portion can have a content of abrasive particles of at least 5 vol % for a total volume of the first abrasive portion. For example, abrasive particles can be present in a content of at least 10 vol % or at least 15 vol % or at least 20 vol % or at least 25 vol % or at least 30 vol % or at least 35 vol % for a total volume of the first abrasive portion as desired by applications of the abrasive article. In another non-limiting embodiment, the first abrasive portion may include not greater than 70 vol % abrasive particles for the total volume of the first abrasive portion, such as not greater than 65 vol % or not greater than 60 vol % or not greater than 55 vol % or not greater than 50 vol % or not greater than 45 vol % or not greater than 40 vol % or not greater than 35 vol % or not greater than 30 vol %. In a further embodiment, the first abrasive portion can include a content of abrasive particles within a range including any of the minimum to maximum percentages noted above. For example, the content of abrasive particles can be within a range of 5 vol % to 70 vol %, such as within a range of 15 vol % to 45 vol %.

In an embodiment, the first abrasive portion can include at least one filler material that is distinct from the abrasive particles. The filler material can be selected from the group of metals, ceramics, vitreous materials, polymers, needle-shaped materials, flakes, granular-shaped materials, fibrous materials, or any combination thereof. In a particular embodiment, the filler material can include at least one of chopped strand fibers, glass fibers, mineral wool, a metal fiber, a ceramic fiber, a carbon fiber, an aramid fiber, wollastonite, frit, talc, mica, montmorillonite, clay, a pore former, hollow particles, grinding aids, defoamers, or any combination thereof. In another embodiment, the first abrasive portion may be essentially free of filler, such as having a filler content of not greater than 0.1 vol % for a total volume of the second abrasive portion. In yet another embodiment, the first abrasive portion may be free of filler.

In an embodiment, the first abrasive portion can include a certain content of a filler material that may facilitate improved formation and properties of the abrasive article. For example, the content of a filler material can be at least 1 vol % for a total volume of the first abrasive portion, such as or at least 2 vol % or at least 3 vol % or at least 4 vol % or at least 5 vol % or at least 6 vol % or at least 7 vol % or at least 8 vol % or at least 9 vol % or at least 10 vol % or at least 12 vol %. In another non-limiting embodiment, the first abrasive portion may include not greater than 30 vol % of a filler material for a total volume of the first abrasive portion, such as not greater than 25 vol % or not greater than 20 vol % or not greater than 18 vol % or not greater than 15 vol % or not greater than 10 vol % or not greater than 8 vol % or not greater than 6 vol % or not greater than 5 vol % or not greater than 4 vol % or not greater than 3 vol % or not greater than 2 vol %. In a further embodiment, the first abrasive portion can include a filler material within a range including any of the minimum and maximum percentages noted herein. For example, the filler content can be within a range of 1 vol % to 30 vol % for a total volume of the first abrasive portion, such as within a range of 3 vol % to 10 vol %.

In an embodiment, the first abrasive portion can have porosity. The porosity can be in various forms. The porosity can extend throughout at least a portion of the entire volume of the first abrasive portion, and in certain instances, may extend substantially uniformly throughout the entire volume of the first abrasive portion. For instance, the porosity can be closed, open, or include closed porosity and open porosity. Closed porosity can be in the form of discrete pores that are isolated from each other by bond material and/or abrasive particles. Such closed porosity may be formed by pore formers. In other instances, the porosity may be open porosity defining an interconnected network of channels extending throughout at least a portion of the three-dimensional volume of the first abrasive portion. In an embodiment, the porosity can include a type of porosity selected from the group consisting of closed porosity, open porosity, and a combination thereof. In another embodiment, the majority of the porosity can include open porosity. In a particular embodiment, all of the porosity can essentially be open porosity. Still, in another embodiment, the majority of the porosity can include closed porosity. For example, all of the porosity can be essentially closed porosity.

In an embodiment, the first abrasive portion can have certain porosity to facilitate improved formation and properties of the abrasive article. In an embodiment, the first abrasive portion can have porosity of at least 1 vol % for a total volume of the first abrasive portion. For example, the first portion can have at least 5 vol % porosity or at least 10 vol % or at least 15 vol % or at least 20 vol % or at least 25 vol % or at least 30 vol % or at least 35 vol % or at least 40 vol % or at least 45 vol % or at least 50 vol % or at least 55 vol %. In another non-limiting embodiment, the first abrasive portion may have not greater than 85 vol % porosity for the total volume of the first abrasive portion, such as not greater than 80 vol % or not greater than 70 vol % or not greater than 60 vol % or not greater than 55 vol % or not greater than 50 vol % or not greater than 45 vol % or not greater than 40 vol % or not greater than 30 vol %. In a further embodiment, the first abrasive portion can have porosity within a range including any of the minimum and maximum percentages noted herein. For example, porosity can be within a range of 1 vol % to 85 vol % for a total volume of the first abrasive portion, such as within a range of 30 vol % to 60 vol %.

In an embodiment, the first abrasive portion can include a particular elastic modulus (EMOD) to facilitate formation of an abrasive article having improved mechanical property and functionality. In an embodiment, the first abrasive portion can have an EMOD of at least 0.9 GPa, at least 1.5 GPa, at least 2 GPa, at least 5 GPa, at least 8 GPa, at least 10 GPa, at least 15 GPa, at least 20 GPa, at least 25 GPa, at least 30 GPa, at least 35 GPa or at least 40 GPa. In another non-limiting embodiment, the first abrasive portion may have an EMOD of not greater than 100 GPa, such as not greater than 85 GPa, such as not greater than 75 GPa, not greater than 50 GPa, or not greater than 40 GPa. In a further embodiment, the first abrasive portion can have an EMOD within a range including any of the minimum and maximum values disclosed herein. For instance, the first abrasive portion can have an EMOD within a range including at least 0.9 GPa and not greater than 100 GPa, such as within a range including at least 10 GPa and not greater than 75 GPa, or within a range including at least 20 GPa and not greater than 50 GPa. In this disclosure, an EMOD is measured using a GrindoSonic device following the manufacturer instruction. In brief, a sample of the interior portion is placed in contact with the point of a piezo-electric detector and excited into vibration through the means of a light tap. Vibration frequency is detected by the device and converted into EMOD following the instructions provided by the manufacturer.

In an embodiment, the body can include a second abrasive portion, wherein the second abrasive portion is distinct and separate from the first abrasive portion. The second abrasive portion can include abrasive particles contained within a bond material. In a particular embodiment, the second abrasive portion can include abrasive particles contained within a three-dimensional network of a bonded matrix of a bond material. In a further embodiment, the bond material can include an organic material. For example, the organic material can include a thermoset or a thermoplastic. In an embodiment, the bond material can include an epoxy, polyurethane, rubber, polyimide, polybenzimidazole, aromatic polyamide, or the like. In another embodiment, the bond material can include an epoxy, an epoxy based material, an epoxy modified material, or the like. In a particular embodiment, the second abrasive portion can include the bond material including epoxy.

In an embodiment, the second abrasive portion can have a certain content of a bond material, which may facilitate improved formation and properties of the abrasive article. For example, the second abrasive portion can include at least 2 vol % bond material for a total volume of the second abrasive portion, such as at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol %. In another instance, the second abrasive portion may include not greater than 80 vol % bond material for the total volume of the second abrasive portion, such as or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol %. In a further embodiment, the second abrasive portion can include a bond material at a content within a range including any of the minimum and maximum percentages noted herein. For example, the content can be within a range of 2 vol % to 80 vol % for a total volume of the second abrasive portion, such as within a range of 15 vol % to 80 vol %.

In an embodiment, abrasive particles contained within the second abrasive portion can be the same as or different from those included in the first abrasive portion. For instance, the abrasive particles of the second abrasive portion can include at least one material selected from the group of carbides, nitrides, borides, oxides, superabrasives, or any combination thereof. In another instance, at least a portion of the abrasive particles of the second abrasive portion can include shaped abrasive particles. In still another instance, the abrasive particles of the second abrasive portion can include a blend of different types of abrasive particles including shaped abrasive particles and non-shaped abrasive particles. In a particular embodiment, the abrasive particles of the second abrasive portion can include alumina.

In a further embodiment, abrasive particles included in the first and second abrasive portions can differ in materials, average particle sizes, shapes, properties (e.g., hardness and friability) or any combination thereof. In another embodiment, the abrasive particles included in the first and second abrasive portions can include the same material, but have different shapes, average particle sizes, properties or any combination thereof. In a particular embodiment, the second abrasive portion can include abrasive particles including alumina. In another particular embodiment, both the first and second abrasive portions can include abrasive particles including alumina.

In an embodiment, the abrasive particles of the second abrasive portion can be present in a certain content that may facilitate improved formation and properties of the abrasive article. In an embodiment, the second abrasive portion can have a content of abrasive particles of at least 5 vol % for a total volume of the second abrasive portion, such as at least 10 vol % or at least 15 vol % or at least 20 vol % or at least 25 vol % or at least 30 vol % or at least 35 vol %. In another embodiment, the second abrasive portion may include not greater than 90 vol % abrasive particles for the total volume of the second abrasive portion, such as not greater than 80 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %. In a further embodiment, the second abrasive portion can include abrasive particles in a content within a range including any of the minimum and maximum percentages noted herein. For example, the content can be within a range of 5 vol % to 90 vol % for the total volume of the second abrasive portion, such as within a range of 20 vol % to 90 vol %.

In an embodiment, the first abrasive portion can include abrasive particles having a first average particle size, and abrasive particles within the second abrasive portion can have a second average particle size that is the same as or different than the first average particle size. In a particular embodiment, the second average particle size can be smaller than the first average particle size.

In an embodiment, the abrasive article can have a certain ratio (AP1/AP2) of the first average particle size (AP1) to the second average particle size (AP2) to facilitate improved formation and properties of the abrasive article. In an embodiment, the abrasive particle ratio can be at least 1. In another instance, the abrasive particle ratio can be greater than 1. For example, the abrasive particle ratio (AP1/AP2) can be at least 1.1 or at least 1.2 or at least 1.3 or at least 1.5 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or at least 10 or at least 11 or at least 12 or at least 15. In another embodiment, the abrasive particle ratio (AP1/AP2) may not be greater than 50, such as not greater than 40 or not greater than 30 or not greater than 20 or not greater than 18 or not greater than 15 or not greater than 12. In a further embodiment, the abrasive particle ratio can be within a range including any of the minimum and maximum values noted herein. For instance, the abrasive article can have an abrasive particle ratio (AP1/AP2) within the range including at least 1 and not greater than 50, such as within a range of greater than 1 to not greater than 50, or within a range including at least 3 and not greater than 15.

In some application, the second average particle size may be greater than the first average particle size. Accordingly, the body can include a ratio (AP2/AP1) which can have the same maximum and minimum values as noted above for AP1/AP2.

In an embodiment, the second abrasive portion can optionally include a filler material. The filler material can be distinct from the abrasive particles. In another embodiment, the second abrasive portion can include at least one filler material selected from the group of metals, ceramics, vitreous materials, polymers, needle-shaped materials, flakes, granular-shaped materials, fibrous materials, or any combination thereof. In a further embodiment, the filler material can include at least one of chopped strand fibers, glass fibers, mineral wool, a metal fiber, a ceramic fiber, a carbon fiber, an aramid fiber, wollastonite, frit, talc, mica, montmorillonite, clay, a pore former, hollow particles, grinding aids, defoamers, or any combination thereof. One particular example of a suitable filler material can include graphite. In a further embodiment, the second abrasive portion may include a filler material in a content of not greater than 15 vol % of the total volume of the second abrasive portion, such as not greater than 12 vol %, not greater than 10 vol %, or, not greater than 7 vol %. In some applications, graphite can be present in the second abrasive portion for up to 5 wt % for the total weight of the second abrasive portion, or up to 4 vol % of the total volume of the second abrasive portion. In another embodiment, the second abrasive portion may be essentially free of filler, such as having a filler content of not greater than 0.1 vol % for a total volume of the second abrasive portion.

In another instance, the second abrasive portion can include a filler material at a certain content that may facilitate improved formation and properties of the abrasive article. In an embodiment, the second abrasive portion can include up to 55 vol % of a filler material for the total volume of the second abrasive portion. In a further embodiment, the second abrasive portion may include not greater than 50 vol % for the total volume of the second abrasive portion, such as not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 2 vol %. In another embodiment, the second abrasive portion can include at least 1 vol % filler for a total volume of the second abrasive portion or at least 2 vol % or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 20 vol % or at least 25 vol % or at least 30 vol % or at least 35 vol %. In a further embodiment, the second abrasive portion can include a filler material at a content within a range including any of the minimum and maximum percentages noted herein. For example, the second abrasive portion can include up to 50 vol % of a filler material, such as up to 40 vol % for the total volume of the second abrasive portion. In another embodiment, the second abrasive portion can include a filler content within a range of 1 vol % to 50 vol %.

In an embodiment, the second abrasive portion can have porosity in various forms. For instance, the porosity can be closed, open, or include closed porosity and open porosity. In an embodiment, the porosity can include a type of porosity selected from the group consisting of closed porosity, open porosity, and a combination thereof. In another embodiment, the majority of the porosity can include open porosity. In a particular embodiment, all of the porosity can essentially be open porosity. Still, in another embodiment, the majority of the porosity can include closed porosity. For example, all of the porosity can be essentially closed porosity.

In an embodiment, the second abrasive portion may have a certain content of porosity that may facilitate improved formation and properties of the abrasive article. For example, the second portion can have least 1 vol % porosity for a total volume of the second abrasive portion, such as at least 5 vol % or at least 10 vol % or at least 15 vol % or at least 20 vol % or at least 25 vol % or at least 30 vol % or at least 35 vol %. In another instance, the second abrasive portion may have not greater than 55 vol % porosity for the total volume of the second abrasive portion, such as not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 2 vol %. In still another embodiment, the second abrasive portion can be essentially free of porosity, such as having not greater than 0.5 vol % porosity for the total volume of the second abrasive portion, or can be free of porosity. In a further embodiment, the second abrasive portion can have a content of porosity within a range including any of the minimum and maximum percentages noted herein. For example, the second abrasive portion can have up to 50 vol % porosity, such as up to 40 vol % porosity for the total volume of the second abrasive portion. In another embodiment, the second abrasive portion can have a content of porosity within a range of 1 vol % to 55 vol %.

In an embodiment, the second abrasive portion can include a particular elastic modulus (EMOD) that may facilitate formation of an abrasive article having improved mechanical property and functionality. The EMOD for the second abrasive portion is measured in the same manner as noted herein for the first abrasive portion. In an embodiment, the second abrasive portion can have an EMOD of at least 0.5 GPa, at least 0.9 GPa, at least 1.5 GPa, at least 2 GPa, at least 3 GPa, at least 4 GPa, at least 5 GPa, or higher. In a further embodiment, the second abrasive portion can have an EMOD of at least 6 GPa, at least 7 GPa, at least 10 GPa, at least 15 GPa, or at least 25 GPa. In another embodiment, the second abrasive portion may have an EMOD of not greater than 100 GPa. For instance, the second abrasive portion may have an EMOD of not greater than 85 GPa, such as not greater than 75 GPa, not greater than 50 GPa, not greater than 35 GPa, or not greater than 15 GPa. In a further embodiment, the second abrasive portion can have an EMOD within a range including any of the minimum and maximum values disclosed herein. For instance, the second abrasive portion can have an EMOD within a range including at least 0.5 GPa and not greater than 100 GPa, such as within a range including at least 0.9 GPa and not greater than 85 GPa.

In another embodiment, the abrasive article can include a body including the first abrasive portion and the second abrasive portion. In a further embodiment, the first and second abrasive portions can be directly or indirectly coupled to each other. For instance, an adhesive, such as glue, can be used to attach the abrasive portions directly to each other. For example, the first abrasive portion is directly bonded to the second abrasive portion. In still another embodiment, the body may include one or more additional portions (e.g., a third abrasive portion) that can be disposed between the first and second abrasive portions.

In a further embodiment, the body can include at least a third abrasive portion coupled to the first abrasive portion or second abrasive portion directly or with the aid of an adhesive. The third abrasive portion can include abrasive particles contained in a bonded matrix of a bond material. The bond material can include an inorganic material or an organic material noted in this disclosure. The third abrasive portion can include any of the other components and contents noted herein for the first or second abrasive portion.

In an embodiment, the body can include an interior portion. The interior portion can be coupled to the first abrasive portion and the second abrasive portion. In a particular embodiment, the abrasive article can include a body including the first abrasive portion, the second abrasive portion, and the interior portion. In a more particular embodiment, the body can include the interior portion directly coupled to both the first and second abrasive portions. It will be appreciated that the interior portion can be coupled to any other additional abrasive portions.

Figure 2:
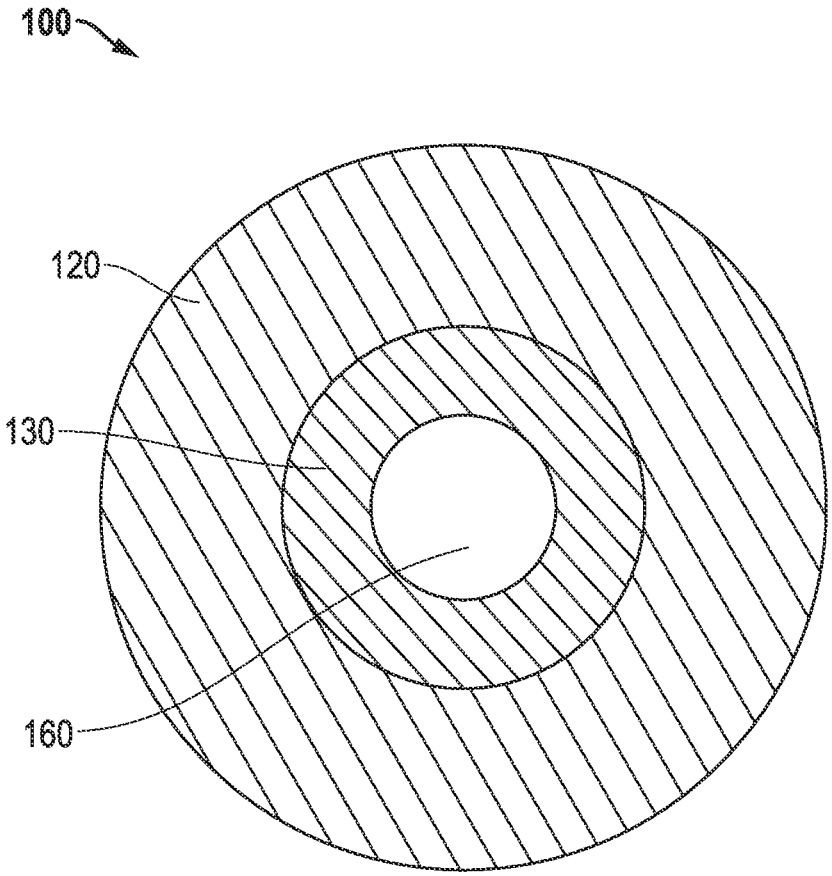
FIG. 2 includes an illustration of another side view of an abrasive article in accordance with an embodiment.

FIG. 1 includes an illustration of a side view of an abrasive article of an embodiment. As illustrated, the abrasive article 100 can be a wheel having a body including a first portion 110 and an interior portion 130. The interior portion 130 defines a central aperture 160 through the body. The opposite side of the same abrasive article is illustrated in FIG. 2. A second abrasive portion 120 is also attached to the interior portion 130. A cross-sectional view of the same abrasive article is included in FIG. 3. As illustrated, the interior portion 130 is attached to both the first abrasive portion 110 and the second abrasive portion 120.

Figure 3:
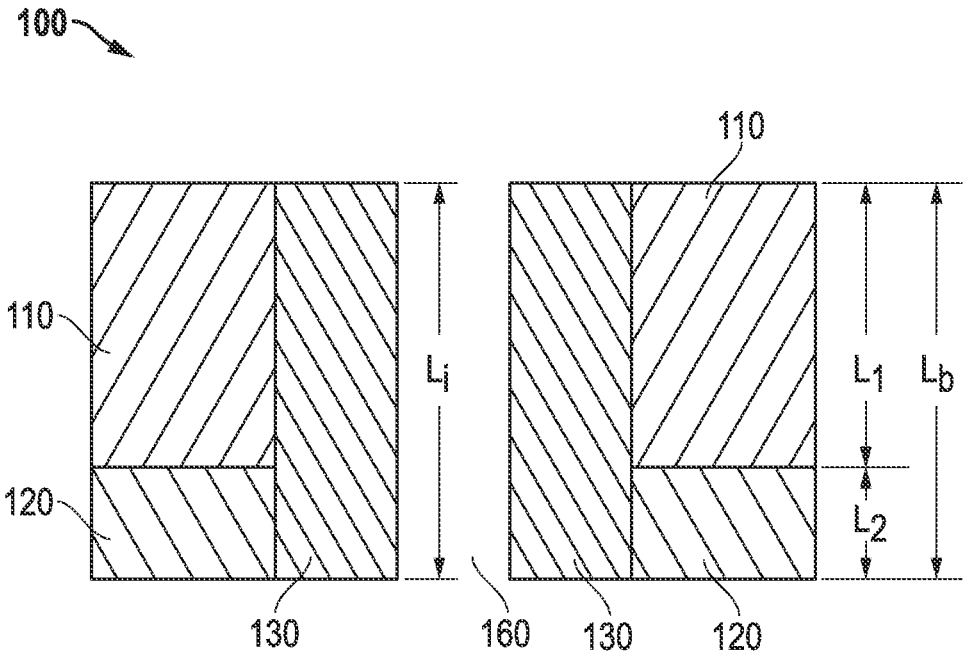
FIG. 3 includes an illustration of a cross-sectional view of the abrasive article in accordance with an embodiment.

In an embodiment, the interior portion can have a length extending along a longitudinal axis of the body that defines a length of the body. In a particular embodiment, the length of the interior portion can extend for the entire length of the body. In another embodiment, the first abrasive portion can have a length that can extend for a portion of a total length of the body. In yet another embodiment, the second abrasive portion can have a length that can extend for a portion of the length of the body. As illustrated in FIG. 3, the interior portion 130 has a length Li that extends for the entire length of the body, Lb. The first portion 110 has a length L1, and the second portion 120 has a length L2. The total of L1 and L2 is the total length of the body, Lb.

In an embodiment, the interior portion can include a bond material including an organic material that may facilitate improved formation and operation of the abrasive article. The bond material included in the interior portion may be the same as or different than the bond material included in the second abrasive portion. In an embodiment, the interior portion can include a thermoset or thermoplastic. In another embodiment, the interior portion can include an epoxy, epoxy based material, or epoxy modified material. In a particular embodiment, the interior portion can include an epoxy. In another particular embodiment, the interior portion and the second abrasive portion can both include an epoxy. In a more particular embodiment, the interior portion can include an epoxy that is different than the epoxy included in the second abrasive portion. In another more particular embodiment, the interior portion and the second abrasive portion can include the same epoxy.

In an embodiment, the interior portion can include a certain content of a bond material to facilitate improved formation and properties of the abrasive article. In an embodiment, the interior portion can include at least 2 vol % of a bond material for a total volume of the interior portion, such as at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol % or at least 25 vol % or at least 30 vol % or at least 35 vol % or at least 40 vol % or at least 45 vol % or at least 55 vol % or at least 57 vol % or at least 60 vol % or at least 65 vol % or at least 70 vol % or at least 75 vol % or at least 80 vol % or at least 82 vol % or at least 85 vol % or at least 90 vol % or at least 95 vol % or at least 99 vol %. In another embodiment, the interior portion may include not greater than 99.99 vol % of a bond material for the total volume of the interior portion, such as not greater than 95 vol % or not greater than 90 vol % or not greater than 85 vol % or not greater than 82 vol % or not greater than 80 vol % or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %. In a further embodiment, the interior portion can include a bond material content within a range including any of the minimum and maximum percentages noted herein. For example, the interior portion can include a content of bond material in a range of 3 vol % to 99.99 vol % for a total volume of the interior portion, such as in a range of 40 vol % to 95 vol % or within a range of 57 vol % to 82 vol %.

In an embodiment, the interior portion can include abrasive particles, filler, or both that may facilitate improved formation and operation of the abrasive article. In another embodiment, the interior portion can include abrasive particles contained within the bonded matrix of the bond material. In yet another embodiment, the interior portion can include abrasive particles that are the same as abrasive particles contained within the second abrasive portion. In still another embodiment, the abrasive particles of the interior portion can differ from those of the second abrasive portion. In yet another embodiment, the abrasive particles of the interior portion can include at least one material selected from the group of carbides, nitrides, borides, oxides, superabrasives, or any combination thereof. In a further embodiment, at least a portion of the abrasive particles of the interior portion can include shaped abrasive particles. In another embodiment, the abrasive particles of the interior portion can include a blend of different types of abrasive particles including shaped abrasive particles and non-shaped abrasive particles. In a particular embodiment, the interior portion can include abrasive particles including alumina. In a more particular embodiment, the interior portion can include abrasive particles including cubic white alumina.

In an embodiment, the interior portion can include a certain content of abrasive particles that may facilitate improved formation and properties of the abrasive article. For example, the interior portion can include abrasive particles in a content of at least 5 vol % for a total volume of the interior portion, such as at least 7 vol % or at least 9 vol % or at least 10 vol % or at least 15 vol % or at least 20 vol % or at least 25 vol % or at least 30 vol % or at least 35 vol %. In another embodiment, the interior portion may include not greater than 80 vol % abrasive particles for the total volume of the interior portion, such as not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %. In a further embodiment, the interior portion can include abrasive particles in a content within a range including any of the minimum to maximum percentages noted herein. For example, the interior portion can include a content of abrasive particles in a range of 5 vol % to 80 vol % for a total volume of the interior portion, such as in a range of 10 vol % to 55 vol % or within a range of 9 vol % to 43 vol %. In a particular embodiment, the interior portion can be essentially free of abrasive particles, such as the content of abrasive particles within the interior portion not greater than 0.5 vol % for the total volume of the interior portion. In another particular embodiment, the interior portion may include filler materials and may be essentially free of or free of abrasive particles.

In a further embodiment, the abrasive particles of the interior portion can have a certain average particle size that can facilitate improved formation and performance of the abrasive article. For instance, the average particle size can be at least 10 microns, such as at least 15 microns, at least 26 microns, at least 40 microns, at least 55 microns, at least 58 microns, at least 63 microns, at least 66 microns, at least 70 microns, at least 85 microns, or at least 120 microns. In a further embodiment, the average particle size may not be greater than 210 microns, such as not greater than 185 microns, not greater than 160 microns, not greater than 140 microns, not greater than 120 microns, not greater than 105 microns, not greater than 85 microns, not greater than 70 microns, or not greater than 66 microns. Moreover, the average particle size of the abrasive particles of the interior portion can be within a range including any of the minimum and maximum values noted herein.

In an embodiment, the interior portion can include a filler contained within the bond material. In a further embodiment, the filler can be distinct from abrasive particles. For example, the filler can include a different material than abrasive particles. In another instance, the filler can have a hardness that is less than the hardness of abrasive particles. In another particular embodiment, the interior portion can include at least one filler material contained within the bonded matrix of the bond material and be essentially free of abrasive particles. In yet another embodiment, the interior portion can include abrasive particles and a filler material. In yet another embodiment, the interior portion can be essentially free of abrasive particles and filler material.

In an embodiment, the interior portion can include at least one filler material selected from the group of metals, ceramics, vitreous materials, polymers, needle-shaped materials, flakes, granular-shaped materials, fibrous materials, or any combination thereof. In a particular embodiment, the filler material can include at least one of chopped strand fibers, glass fibers, mineral wool, a metal fiber, a ceramic fiber, a carbon fiber, an aramid fiber, wollastonite, frit, talc, mica, montmorillonite, clay, a pore former, hollow particles, grinding aids, defoamers, or any combination thereof. An example of chopped strand fibers can include basalt fibers, glass fibers, or a combination thereof. In a particularly embodiment, the interior portion may include chopped strand fibers having a certain length, width or both that can facilitate improved formation and performance of the abrasive article. For example, the chopped strand fibers can have a diameter of at least 6 microns, such as at least 8 microns, at least 10 microns, or at least 12 microns. In another instance, the chopped strand fibers may have a diameter of not greater than 18 microns, such as not greater than 16 microns, not greater than 15 microns, not greater than 13 microns, not greater than 12 microns, or not greater than 10 microns. Moreover, the chopped strand fibers can have a diameter within a range including any of the minimum and maximum values noted herein, such as within a range including at least 9 microns and not greater than 12 microns. Alternatively or additionally, the chopped strand fibers can have a length of at least 2 mm, such as at least 2.5 mm, at least 3 mm, at least 3.2 mm or at least 3.8 mm or at least 4 mm or at least 4.3 mm or at least 4.5 mm. In another instance, the length of the chopped strand fibers may not be greater than 5.6 mm, such as not greater than 5.3 mm or not greater than 5.1 mm or not greater than 4.8 mm or not greater than 4.5 mm or not greater than 4 mm. Moreover, the chopped strand fibers can have a length within a range including any of the minimum and maximum values disclosed herein, such as within a range including at least 2 mm and not greater than 5.6 mm or within a range including at least 4 mm and not greater than 5 mm. In at least one particular embodiment, the interior abrasive portion can include chopped strand glass fibers. More particularly, the chopped strand glass fibers can have any of the diameter and/or the length noted herein.

In an embodiment, the interior portion can include a filler in a certain content to facilitate improved formation and properties of the abrasive article. In an embodiment, the interior portion can include at least 1 vol % filler for a total volume of the interior portion, such as at least 2 vol % or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol %. In another embodiment, the interior portion may include not greater than 80 vol % filler for a total volume of the interior portion, such as not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 3 vol % or not greater than 1 vol %. In a further embodiment, the interior portion can include a filler content within a range including any of the minimum to maximum percentages noted herein. For example, the interior portion can include filler in a content in a range of 1 vol % to 80 vol % for a total volume of the interior portion, such as in a range of 3 vol % to 50 vol %.

In an embodiment, the interior portion can have porosity at a certain content that may facilitate improved formation and properties of the abrasive article. For example, the interior portion can have at least 1 vol % porosity for a total volume of the interior portion or at least 5 vol % or at least 10 vol % or at least 15 vol % or at least 20 vol % or at least 25 vol % or at least 30 vol %. In another embodiment, the interior portion may have not greater than 50 vol % porosity for the total volume of the interior portion or not greater than 45 vol % or not greater than 40 vol % or not greater than 35 vol % or not greater than 30 vol % or not greater than 25 vol % or not greater than 20 vol % or not greater than 15 vol % or not greater than 10 vol %. In a further embodiment, the interior portion can have porosity in a content within a range including any of the minimum to maximum percentages noted herein. For example, the interior portion can have porosity at a content in a range of 1 vol % to 50 vol % for the total volume of the interior portion, such as in a range of 5 vol % to 30 vol %. In another particular embodiment, the interior portion may be essentially free of porosity, such as the content of porosity is not greater than 0.5 vol % for a total volume of the interior portion.

In an embodiment, the interior portion can include a particular elastic modulus (EMOD) that may facilitate formation of an abrasive article having improved mechanical property and functionality. The EMOD of the interior portion is measured in the same manner as noted herein for the other portions. In a non-limiting embodiment, the interior portion can have an EMOD of at least 0.5 GPa, such as at least 0.9 GPa, at least 1.2 GPa, at least 1.8 GPa, at least 2.5 GPa, or at least 4 GPa. In a further embodiment, the interior portion can have an EMOD of at least 6 GPa, at least 7 GPa, at least 10 GPa, at least 15 GPa, or at least 25 GPa. In another non-limiting embodiment, the interior portion may have an EMOD of not greater than 100 GPa. For instance, the interior portion may have an EMOD of not greater than 85 GPa, such as not greater than 75 GPa, not greater than 50 GPa, not greater than 35 GPa, or not greater than 15 GPa. In a further embodiment, the interior portion can have an EMOD within a range including any of the minimum and maximum values disclosed herein. For instance, the interior portion can have an EMOD within a range including at least 0.5 GPa and not greater than 100 GPa, such as within a range including at least 0.9 GPa and not greater than 75 GPa, or within a range including at least 1.8 GPa and not greater than 50 GPa.

In a further embodiment, the second abrasive portion can have a different EMOD than the EMOD of the interior portion. For example, the second abrasive portion can have an EMOD that is greater than the EMOD of the interior portion. In another instance, the interior portion can have the greater EMOD as compared to the second abrasive portion. In yet another embodiment, the EMODs of the second abrasive portion and the interior portion are the same.

In a further embodiment, the abrasive article can have a certain EMOD ratio (EMOD2/EMODi) of the second abrasive portion EMOD (EMOD2) to the interior portion EMOD (EMODi), which may facilitate improved formation and properties of the abrasive article. In an embodiment, the EMOD ratio (EMOD2/EMODi) can be at least 1, such as at least 1.1 or at least 1.2 or at least 1.5 or at least 2 or at least 3 or at least 4 or at least 5 or at least 8 or at least 10 or at least 20 or at least 50 or at least 100. In another instance, the EMOD ratio (EMOD2/EMODi) may be not greater than 500 or not greater than 400 or not greater than 300 or not greater than 200 or not greater than 100 or not greater than 75 or not greater than 50. In a further embodiment, the EMOD ratio (EMOD2/EMODi) can be within a range including any of the minimum and maximum values noted herein. For instance, the EMOD ratio (EMOD2/EMODi) can be in a range of at least 1 and not greater than 500, such as in a range of at least 5 to not greater than 100.

In a further embodiment, the abrasive article can have a certain EMOD ratio (EMODi/EMOD2) of the interior portion EMOD (EMODi) to the second abrasive portion EMOD (EMOD2), which may facilitate improved formation and properties of the abrasive article. In an embodiment, the EMOD ratio (EMODi/EMOD2) can be at least 1, such as at least 1.1 or at least 1.2 or at least 1.5 or at least 2 or at least 3 or at least 4 or at least 5 or at least 8 or at least 10 or at least 20 or at least 50 or at least 100. In another instance, the EMOD ratio (EMODi/EMOD2) may be not greater than 500 or not greater than 400 or not greater than 300 or not greater than 200 or not greater than 100 or not greater than 75 or not greater than 50. In a further embodiment, the EMOD ratio (EMODi/EMOD2) can be within a range including any of the minimum and maximum values noted herein. For instance, the EMOD ratio (EMODi/EMOD2) can be in a range of at least 1 and not greater than 500, such as in a range of at least 5 to not greater than 100.

In a further embodiment, the abrasive article can have a certain EMOD ratio (EMOD1/EMOD2) of the first abrasive portion EMOD (EMOD1) to the second abrasive portion EMOD (EMOD2), which may facilitate improved formation and properties of the abrasive article. In an embodiment, the EMOD ratio (EMOD1/EMOD2) can be at least 1, such as at least 1.1 or at least 1.2 or at least 1.5 or at least 2 or at least 3 or at least 4 or at least 5 or at least 8 or at least 10 or at least 20 or at least 50 or at least 100. In another instance, the EMOD ratio (EMOD1/EMOD2) may be not greater than 500 or not greater than 400 or not greater than 300 or not greater than 200 or not greater than 100 or not greater than 75 or not greater than 50. In a further embodiment, the EMOD ratio (EMOD1/EMOD2) can be within a range including any of the minimum and maximum values noted herein. For instance, the EMOD ratio (EMOD1/EMOD2) can be in a range of at least 1 and not greater than 500, such as in a range of at least 5 to not greater than 100.

In a further embodiment, the abrasive article can have a certain EMOD ratio (EMOD2/EMODi) of the first abrasive portion EMOD (EMOD1) to the interior portion EMOD (EMODi), which may facilitate improved formation and properties of the abrasive article. In an embodiment, the EMOD ratio (EMOD1/EMODi) can be at least 1, such as at least 1.1 or at least 1.2 or at least 1.5 or at least 2 or at least 3 or at least 4 or at least 5 or at least 8 or at least 10 or at least 20 or at least 50 or at least 100. In another instance, the EMOD ratio (EMOD1/EMODi) may be not greater than 500 or not greater than 400 or not greater than 300 or not greater than 200 or not greater than 100 or not greater than 75 or not greater than 50. In a further embodiment, the EMOD ratio (EMOD1/EMODi) can be within a range including any of the minimum and maximum values noted herein. For instance, the EMOD ratio (EMOD1/EMODi) can be in a range of at least 1 and not greater than 500, such as in a range of at least 5 to not greater than 100.

Figure 4A:
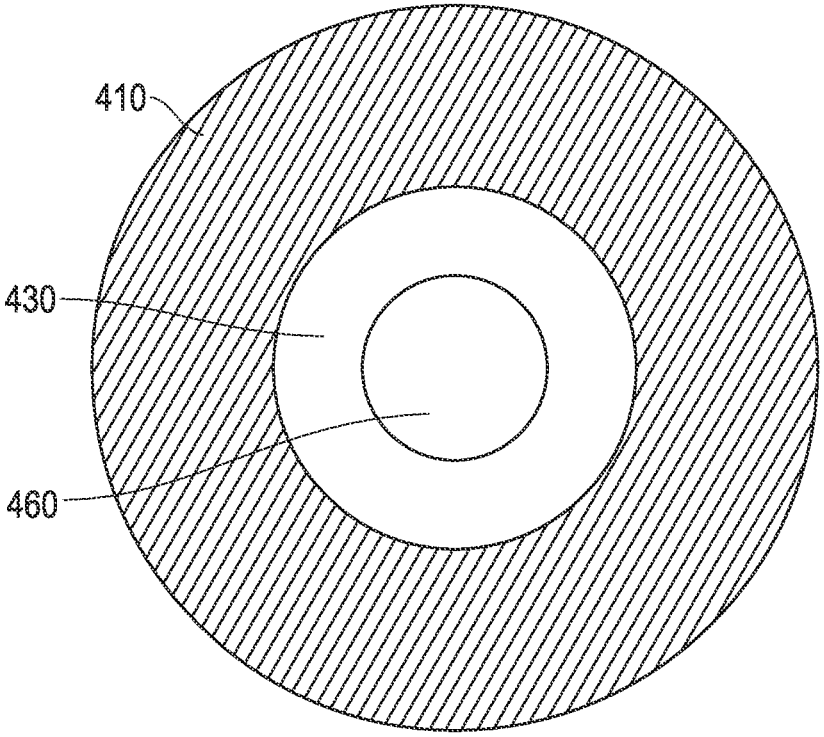
FIG. 4A and FIG. 4B include illustrations of side views of a same abrasive article in accordance with another embodiment.
Figure 4B:
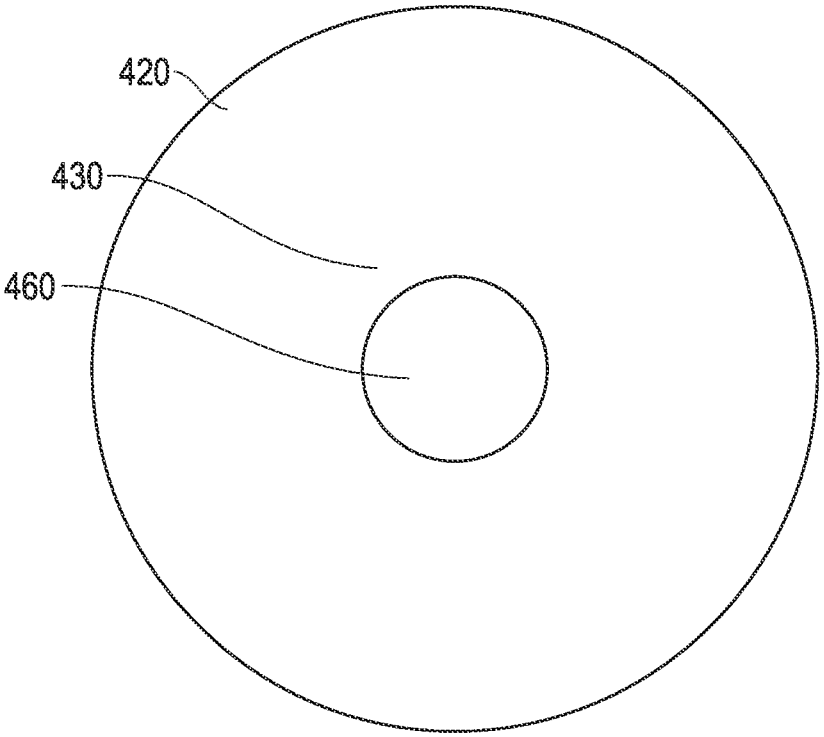
Figure 5:
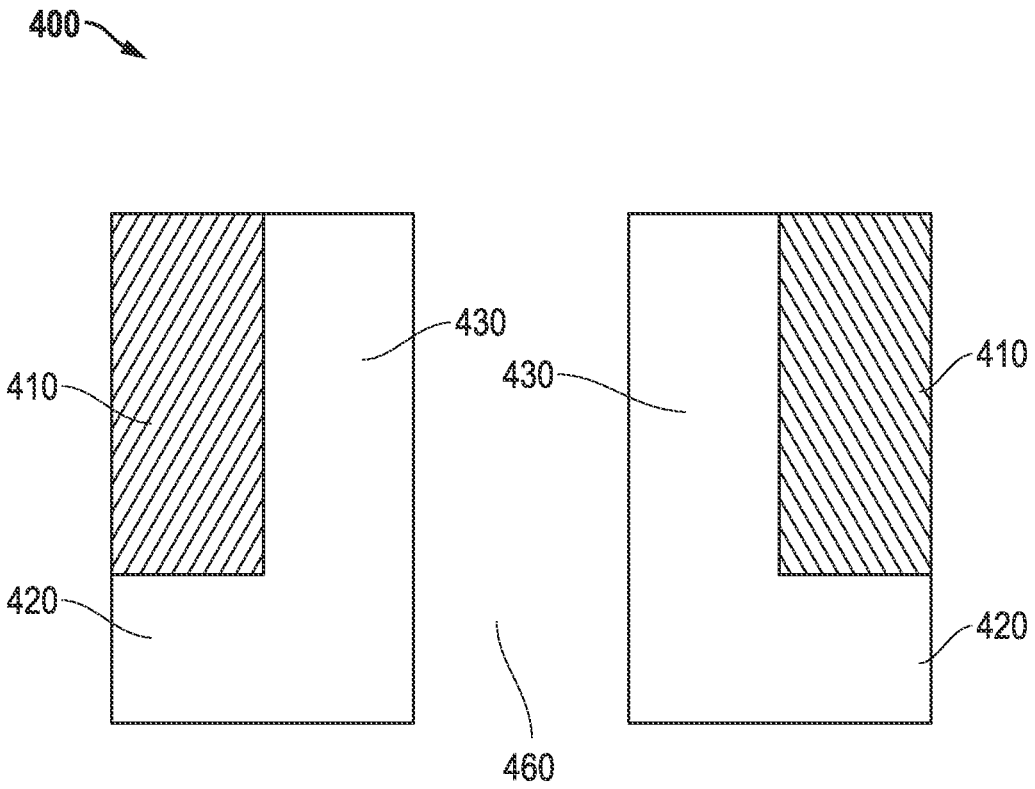
FIG. 5 includes an illustration of a cross-sectional view of an abrasive article in accordance with another embodiment.

In an embodiment, the body of the abrasive article may include the first abrasive portion, the second abrasive portion, and the interior portion, in which the second abrasive portion can be integrally formed together with the interior portion such that they form the same portion. In a further embodiment, the second portion and the interior portion can define the same monolithic portion that is bonded to the first abrasive portion. An illustration of an exemplary abrasive article in accordance with these embodiments is included in FIGS. 4A, 4B and 5. FIG. 4A includes an illustration of a side view of an abrasive article 400 demonstrating the first abrasive portion 410 and interior portion 430 defining a through aperture 460. The opposite side of the abrasive article 400 is illustrated in FIG. 4B. The second abrasive portion 420 and the interior portion 430 are the same monolithic portion defining the aperture 460, and an interface is not formed between the second abrasive portion 420 and the interior portion 430. FIG. 5 includes an illustration of the cross-sectional view of the same abrasive article of FIGS. 4A and 4B. The monolithic portion of the second abrasive portion 420 and the interior portion 430 is coupled to the first abrasive portion 410. The first and second abrasive portions of these embodiments can have the same features as noted herein for the first and second abrasive portions of other embodiments. In another embodiment, the second abrasive portion can have any of the features of the interior portion as described above. Thus, according to one embodiment, the second portion and the interior portion of the body can be the same.

Figure 6:
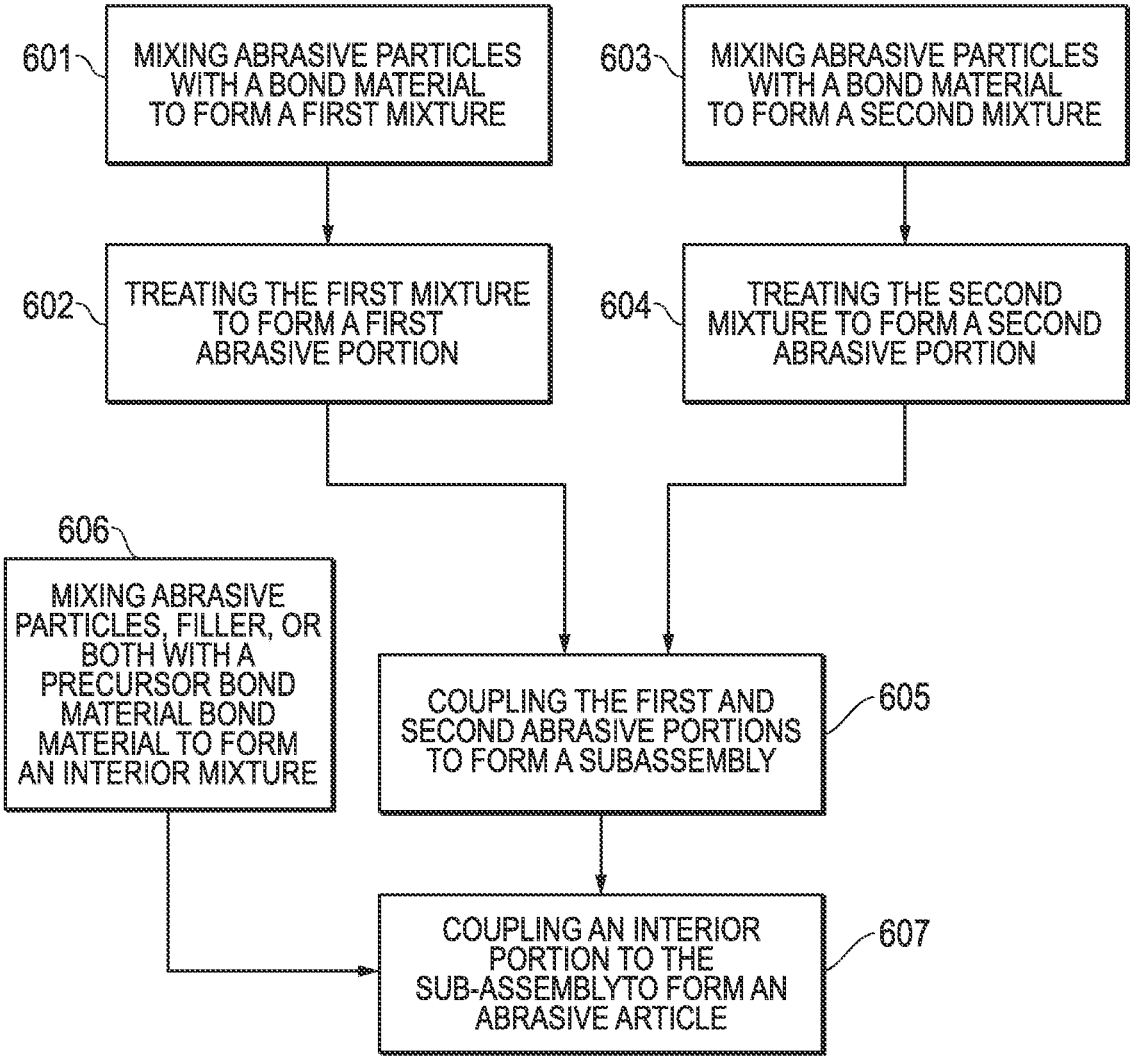
FIG. 6. includes a flow chart for forming an abrasive article in accordance with an embodiment.

FIG. 6 includes a flowchart illustrating a process of making an abrasive article in accordance with an embodiment. As illustrated, the first and second abrasive portions can be formed separately, and the process can start at either step 601 or 603, as desired, forming a first or second mixture including abrasive particles and a bond or a precursor bond material. The precursor bond material can form a bond material of a finally-formed abrasive portion. An exemplary precursor bond material can include a frit, a vitrified material, or a resin.

The bond material or a precursor bond material can be in the form of powder or liquid that can be mixed with abrasive particles. The first and second mixtures can be dry or wet. The mixture may also include one or more optional additives, including for example, secondary abrasive particles, a filler material, and the like. A binder can be added in the first mixture to facilitate bonding of the bond material. In certain instances, suitable mixing operations can be utilized to achieve homogenous dispersion of the components within the mixture.

In an embodiment, various abrasive particles can be suitable for forming the first abrasive portion, the second abrasive portion, and the interior portion. An exemplary abrasive particle can include an oxide, a carbide, a carbon-based material (e.g., diamond), a nitride, a boride, an oxycarbide, an oxynitride, an oxyboride, or any combination thereof. In another embodiment, abrasive particles can include a superabrasive material. In a further embodiment, abrasive particles can include a material including silicon dioxide, silicon carbide, alumina, zirconia, flint, garnet, emery, rare earth oxides, rare earth-containing materials, cerium oxide, sol-gel derived particles, gypsum, iron oxide, glass-containing particles, sintered bauxite, cubic boron nitride, diamond, or a combination thereof. In a particular embodiment, the abrasive particles can include alumina-based abrasive particles. For example, abrasive particles can include brown fused alumina, white alumina (e.g., cubic white alumina grain and sharp white alumina grain), seeded gel abrasive, sintered alumina with additives, shaped and sintered alumina, pink alumina, ruby alumina, monocrystalline alumina, alumina zirconia abrasives, aluminum oxynitride, sintered alumina, extruded alumina, nanocrystalline alumina, or any combination thereof. In a more particular embodiment, abrasive particles can consist essentially of alumina, such as alpha alumina. In another embodiment, the abrasive particles can have a Mohs hardness or at least 7, such as at least 8, or even at least 9.

In a further embodiment, abrasive particles can include shaped abrasive particles. For instance, at least a portion of the abrasive particles contained within the first abrasive portion, the second abrasive portion, or the interior portion can include shaped abrasive particles. In still another embodiment, abrasive particles can include a blend of different types of abrasive particles including shaped abrasive particles and non-shaped abrasive particles.

In another embodiment, secondary abrasive particles can include alumina oxide, silicon carbide, cubic boron nitride, diamond, flint and garnet grains, and any combination thereof.

In another embodiment, a filler material can include organic and inorganic materials. The filler material may or may not be present in the finally-formed abrasive article. In a further embodiment, a filler material can be selected from metal, ceramics, a vitreous material, polymers, needle-shaped materials, flakes, granular-shaped materials, fibrous materials, fibers (e.g., carbon or glass), and any combination thereof. In still another embodiment, the filler material can include bubble glass, chopped strand fibers, glass fibers, mineral wool, a metal fiber, a ceramic fiber, a carbon fiber, a aramid fiber, wollastonite, frit, talc, mica, montmorillonite, clay, a pore former, hollow particles, grinding aids, defoamers, Kevlar or any combination thereof.

A suitable binder can include water to aid mixing of all the components to form a homogenous mixture.

After the first or second mixture is formed including all the desirable components, the process can continue at step 602 or 603 by treating the mixture to form the first or second abrasive portion. Some suitable examples of treating can include heating, curing, polymerization, pressing, or a combination thereof. For example, the first mixture can be treated to form a green body including suitable components, such as a frit material and abrasive particles. Particularly, the first mixture can be shaped using a desirable shaping apparatus to form the green body. In some instances, the green body may be dried prior to heat treatment. An exemplary drying method can include use of a dryer. In some instances, the green body can be placed in a dryer at a temperature between 35° C. to 100° C. for days. Heat treatment can be performed to form a vitreous bonded abrasive portion. For example, the green body can be heat treated at a temperature of at least 400° C. In another embodiment, the green body can be heat treated to a forming temperature that can provide sufficient heat for abrasive particles to bond with the bond material. In some instances, the green body can be heat treated in a kiln. In another instance, the forming temperature can be at least 800° C., such as at least 850° C., or at least 875° C. In another embodiment, the forming temperature may help to reduce reactivity of certain materials contained in the bond material. For instance, the forming temperature may not be greater than 1420° C., such as not greater than 1300° C., or not greater than 1250° C. In a further embodiment, the forming temperature can be within a range including any of the minimum and maximum values disclosed herein, such as within a range including at least 800° C. and not greater than 1420° C. or within a range including at least 850° C. and not greater than 1300° C. In another embodiment, the green body can be treated at the forming temperature for at least 2 hours to not greater than 200 hours to form the vitreous first abrasive portion.

The second mixture can include a precursor material including an organic material, such as a natural organic material or a synthetic organic material. In an embodiment, the organic material can include a polymer, such as a curable polymer. In another embodiment, the organic material can include a photocurable material. In still another embodiment, the organic material can include a resin, such as phenolic resins, epoxy resins, polyester resins, polyurethanes, rubber, polyimide, polybenzimidazole, aromatic polyamide, modified phenolic resins (such as: epoxy modified and rubber modified resins, or phenolic resin blended with plasticizers, etc.), or any combination thereof. In a particular embodiment, the precursor bond material can include an epoxy resin.

In another embodiment, the precursor bond material can include a curing agent, such as a hardener, or a cross-link agent. The curing or cross-link agent can include an amine, imidazoles, anhydrides, phenols (e.g., bisphenol A or novolacs), thiols, or the like. Exemplary amines can include tertiary amines or imidazolesethylene diamine; ethylene triamine; methyl amines, or the like.

After the second mixture including, such as a precursor bond material and abrasive particles, is formed, the process can continue to step 604, which can include treating the mixture to form the second abrasive portion. Treating can include shaping the second mixture in a suitable shaping apparatus, such as a mold having a desired shape. Treating can further include curing the second mixture at a proper temperature to form the organic bonded second abrasive portion. Selection of the curing temperature depends, for instance, on factors such as the type of bonding material employed, strength, hardness, and grinding performance desired. In an embodiment, cure can take place in the presence of heat. In at least one embodiment, curing temperature can be in the range including at least 120° C. to not greater than 250° C. In some instances, cure can take place at room temperature (from 20° C. to 25° C.) in the presence of a proper curing agent, such as utilizing amine or polyamino-amide hardeners to allow certain epoxy resins to cure in the room temperature. In some other instances, light can be used to cure suitable resins. Cure can be performed for a period of time. For example, the second mixture can be held at a final cure temperature for a period of time, such as between 6 hours and 48 hours, between 10 and 24 hours, or until the mixture reaches the cross-linking temperature or desired density is obtained.

At step 605, after formation of the first and second abrasive portions, a sub-assembly can be formed by coupling the abrasive portions. In an embodiment, the center apertures of the first and second abrasive portions can be aligned such that the sub-assembly can have a center aperture through the total thickness of the sub-assembly. In a particular embodiment, the first abrasive portion and the second abrasive portion can be formed such that the center apertures can have the same or similar diameters. In another embodiment, the first and second abrasive portions may or may not have the same thickness. In a particular embodiment, the first abrasive portion may have greater thickness than the second abrasive portion. In another particular embodiment, the first and second abrasive portions can have the same or similar thickness. In yet another embodiment, the first and second abrasive portions can have the same or similar perimeters. In another embodiment, coupling can include adhering one abrasive portion to the other.

The process can continue at step 606. An interior mixture can be prepared and formed including a precursor bond material disclosed above. In at least one embodiment, the precursor bond material can include an epoxy resin and at least one hardener. The epoxy resin and hardener can be mixed in a ratio that can allow stoichiometric reaction and complete polymerization reaction to take place. When more than one hardener are used, the ratio between the hardeners can be adjusted to change a property (e.g., elasticity) of the interior portion as desired by applications. In an aspect, the epoxy resin can be non-crystalizing. In another aspect, the epoxy resin can have a certain viscosity that can facilitate improved formation of the abrasive article. Suitable viscosity can be from 5000 mPa·s to 50000 mPa·s. In a particular embodiment, the precursor bond material can consist essentially of an epoxy resin and a hardener. In a more particular embodiment, the precursor bond material can consist essentially of an epoxy resin, a first hardener, and a second hardener The interior mixture can include a certain content of the precursor bond material that can facilitate improved formation of the abrasive article. For instance, the content can be greater than 20 wt % for a total weight of the interior mixture, such as greater than 23 wt %, greater than 24 wt %, or greater than 26 wt %. In another embodiment, the content of the precursor bond material can be at least 28 wt % for the total weight of the interior mixture, such as at least 31 wt %, at least 35 wt %, at least 39 wt %, at least 42 wt %, at least 44 wt %, at least 46 wt %, at least 49 wt %, at least 51 wt %, at least 53 wt %. In a further embodiment, the content of the precursor bond material can be less than 60 wt % for the total weight of the interior mixture, such as less than 58 wt %, less than 56 wt %, or less than 54 wt %. In still another embodiment, the content of the precursor bond material can be not greater than 53 wt %, not greater than 51 wt %, not greater than 49 wt %, not greater than 47 wt %, not greater than 46 wt %, not greater than 43 wt %, not greater than 39 wt %, not greater than 37 wt %, not greater than 34 wt %, or not greater than 30 wt %. Moreover, the precursor bond material can be present in the interior mixture in the content within a range including any of the minimum and maximum values noted herein. In a particular embodiment, the interior mixture including greater than 26 wt % and less than 54 wt % of the precursor bond material for the total weight of the mixture.

The interior mixture can optionally include abrasive particles or a filler material, noted herein, or both. In an embodiment, the mixture can include abrasive particles in a certain content that can facilitate improved formation of the abrasive article. For instance, the content of the abrasive particles can be less than 80 wt %, less than 76 wt % or less than 74 wt % for the total weight of the interior mixture. In another embodiment, the content can be not greater than 72 wt % for the total weight of the interior mixture, such as not greater than 69 wt %, not greater than 66 wt %, not greater than 62 wt %, not greater than 59 wt %, not greater than 57 wt %, not greater than 53 wt %, or not greater than 50 wt %, or not greater than 48 wt % or not greater than 45 wt %. In a further embodiment, the content of the abrasive particles can be greater than 30 wt % for the total weight of the interior mixture, greater than 36 wt %, greater than 42 wt %, or greater than 46 wt %. In a further embodiment, the abrasive particle content can be at least 47 wt % for the total weight of the interior mixture, at least 48 wt %, at least 51 wt %, at least 54 wt %, at least 56 wt %, at least 58 wt %, at least 61 wt %, or at least 63 wt %. Moreover, the content of the abrasive particles can be within a range including any of the minimum and maximum percentages noted herein, such as greater than 46 wt % and less than 74 wt %.

According to at least one embodiment, the precursor bond material can be mixed with the abrasive particles in a certain ratio, Wpb/Wa, wherein Wa and Wpb represent the content of abrasive particles and precursor bond material, respectively. In an aspect, the ratio (Wpb/Wa) can be greater than 0.2, such as greater than 0.3. In another aspect, the ratio (Wpb/Wa) can be at least 0.4, at least 0.6, at least 0.7, at least 0.85, or at least 1.1. In another aspect ratio, the ratio (Wpb/Wa) may be not greater than 1.2, not greater than 1.1, not greater than 0.9, not greater than 0.85, not greater than 0.7, not greater than 0.5, or not greater than 0.4. Moreover, the ratio (Wpb/Wa) can be within a range including any of the minimum and maximum values disclosed herein.

In at least one embodiment, the interior mixture can include a certain content of a filler material that can facilitate improved formation of the abrasive article. For instance, the filler material can be in a content of at least 1 wt % for the total weight of the interior mixture, such as at least 2 wt %, at least 3 wt %, at least 5 wt %, at least 7 wt %, at least 9 wt %, at least 11 wt %, at least 13 wt %, at least 15 wt %, at least 17 wt %, or at least 19 wt %. In another instance, the filler content may be not greater than 35 wt % for the total weight of the interior mixture, such as not greater than 30 wt %, not greater than 27 wt %, not greater than 25 wt %, not greater than 23 wt %, or not greater than 20 wt %. Moreover, the filler content can be within a range including any of the minimum and maximum percentages noted herein, such as within a range including at least 1 wt % and not greater than 30 wt % for the total weight of the interior mixture. In another embodiment, the interior mixture can be essentially free of a filler material, such as including not greater than 0.1 wt % of the fiber material for the total weight of the interior mixture.

The process can continue at step 607. In an embodiment, coupling an interior portion to the sub-assembly can include forming the interior portion separately and coupling the interior portion to the sub-assembly. For instance, the interior mixture can be placed into a suitable shaping apparatus and cured in a suitable condition disclosed herein form the interior portion. The interior portion can then be coupled to both the first and second abrasive portions with the aid of an adhesive to form the abrasive article.

In another embodiment, coupling an interior portion to the sub-assembly can include integrally forming the interior portion on the first abrasive portion and the second abrasive portion simultaneously. For example, the sub-assembly can be placed in a shaping apparatus (e.g., a mold having a desired shape) to receive the interior mixture, which can be in the liquid form. The interior mixture can be simultaneously cast onto interior surfaces of both the first and second abrasive portions. Cure can be performed in a suitable condition as disclosed herein. The interior mixture can be allowed to cure to the interior surfaces of the first abrasive portion and second abrasive portion simultaneously to form the abrasive article including the interior portion bonded to the first and second abrasive portions.

In an embodiment, the abrasive portions and interior portion can be dressed, examined, and balanced, as needed, prior to being coupled.

Figure 7:
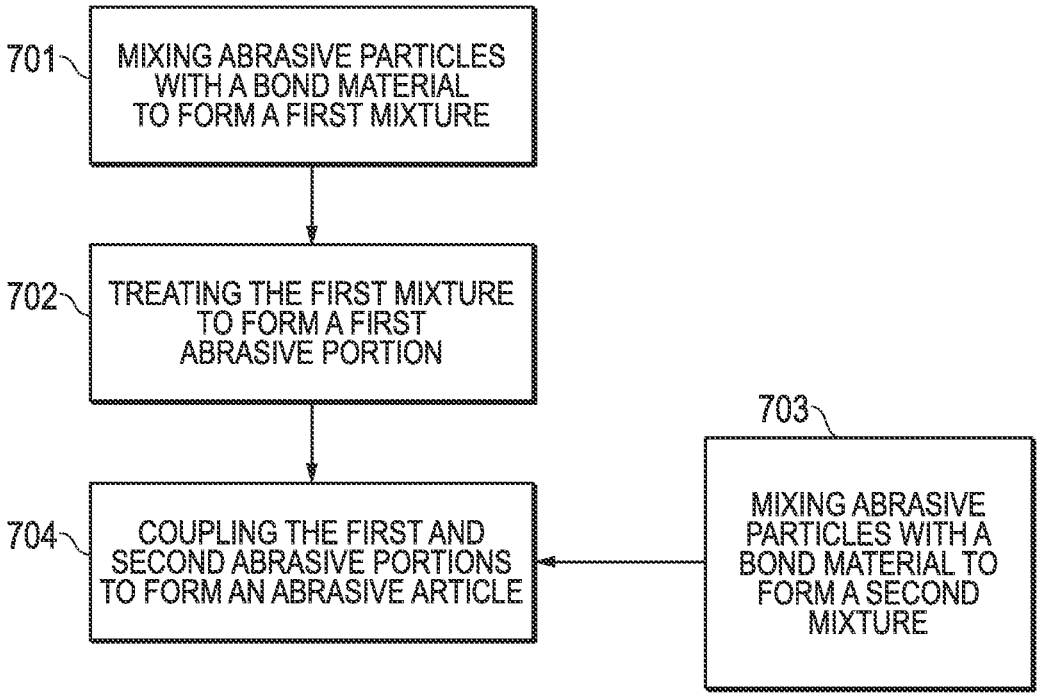
FIG. 7 includes a flow chart for forming an abrasive article in accordance with another embodiment.

FIG. 7 includes a flow chart illustrating a process for forming an abrasive article including the first and second portions. The process can include forming the first abrasive portion, forming the second abrasive portion having a flanged portion, and coupling the first abrasive portion to the second abrasive portion such that the first abrasive portion is adhered to the flanged portion of the second abrasive portion. The process is described in more details below.

Steps 701, 702, and 703 can be performed in the same manner as disclosed in FIG. 6 and described herein. Accordingly, forming the first abrasive portion can include forming a green body including a frit material and abrasive particles, and heat treating the green body at a temperature of at least 400° C. to form the vitreous bonded abrasive portion. In at least one embodiment, the first abrasive portion can be placed in a suitable shaping apparatus (e.g., a mold) with a side surface up to receive the second mixture. In accordance with embodiments herein, the second mixture can include a bond precursor including a suitable polymer and abrasive particles.

At step 704, the second mixture can be cast onto the interior surface and the top side surface of the first abrasive portion without an intervening layer between the second mixture and the first abrasive portion, and allowed to cure to form the organic bonded abrasive portion. In an embodiment, the second abrasive portion can be formed having a flange portion. Particularly, the second abrasive portion having a flange portion can be formed integrally with the first abrasive portion. In another embodiment, the second abrasive portion can be formed including the interior portion. In a particular embodiment, the second abrasive portion and the interior portion can be formed defining the same monolithic portion. Even more particularly, the second abrasive portion and the interior portion are the same portion.

Alternatively, at step 704, the second abrasive portion can be formed separately. For instance, the second mixture can be cast into a mold and allowed to cure. Then, the second abrasive portion can be coupled to the first portion by using an adhesive.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article comprising: a body including: a first abrasive portion comprising abrasive particles contained within a bond material comprising a vitreous material; a second abrasive portion comprising abrasive particles contained within a bond material comprising an organic material, wherein the second abrasive portion is coupled to the first abrasive portion; and an interior portion defining a central aperture through the body, the interior portion coupled to the first abrasive portion and the second abrasive portion, wherein the body comprises an average burst speed of at least 65 m/s.

Embodiment 2. The abrasive article of embodiment 1, wherein the first abrasive portion is bonded directly to the second abrasive portion.

Embodiment 3. The abrasive article of embodiment 1, further comprising at least a third abrasive portion coupled to the first abrasive portion or second abrasive portion.

Embodiment 4. The abrasive article of embodiment 1, wherein the body comprises an average burst speed of at least 70 m/s or at least 75 m/s or at least 80 m/s or at least 85 m/s or at least 90 m/s or at least 95 m/s or at least 100 m/s, or at least 110 m/s or at least 120 m/s or at least 130 m/s or at least 140 m/s or at least 150 m/s or at least 160 m/s or at least 170 m/s or at least 180 m/s.

Embodiment 5. The abrasive article of embodiment 1, wherein the body comprises a burst speed of not greater than 200 m/s or not greater than 180 m/s or not greater than 150 m/s.

Embodiment 6. The abrasive article of embodiment 1, further comprising an adhesive between the first abrasive portion and the second abrasive portion.

Embodiment 7. The abrasive article of embodiment 1, wherein interior portion comprises at least one of: a material comprising an organic material; an elastic modulus (EMOD) within a range of at least 0.5 GPa and not greater than 100 GPa.

Embodiment 8. The abrasive article of embodiment 1, wherein the second abrasive portion comprises a second EMOD and the interior portion comprises an interior EMOD, and wherein the second EMOD is greater than the interior EMOD.

Embodiment 9. The abrasive article of embodiment 1, wherein the second abrasive portion comprises a second EMOD and the interior portion comprises an interior EMOD, and wherein the second EMOD is less than than the interior EMOD Embodiment 10. The abrasive article of embodiment 1, further comprising an EMOD ratio (EMOD2/EMODi), wherein EMOD2 represents an EMOD of the second abrasive portion and EMODi represents an EMOD of the interior portion, wherein the EMOD ratio (EMOD2/EMODi) is at least 1 or at least 1.1 or at least 1.2 or at least 1.5 or at least 2 or at least 3 or at least 4 or at least 5 or at least 8 or at least 10 or at least 20 or at least 50 or at least 100.

Embodiment 11. The abrasive article of embodiment 10, wherein the EMOD ratio (EMOD2/EMODi) is not greater than 500 or not greater than 400 or not greater than 300 or not greater than 200 or not greater than 100 or not greater than 75 or not greater than 50.

Embodiment 12. The abrasive article of embodiment 1, further comprising an EMOD ratio (EMODi/EMOD2), wherein EMODH2 represents an EMOD of the second abrasive portion and EMODi represents an EMOD of the interior portion, wherein the EMOD ratio (EMODi/EMOD2) is at least 1 or at least 1.1 or at least 1.2 or at least 1.5 or at least 2 or at least 3 or at least 4 or at least 5 or at least 8 or at least 10 or at least 20 or at least 50 or at least 100.

Embodiment 13. The abrasive article of embodiment 12, wherein the EMOD ratio (EMODi/EMOD2) is not greater than 500 or not greater than 400 or not greater than 300 or not greater than 200 or not greater than 100 or not greater than 75 or not greater than 50.

Embodiment 14. The abrasive article of embodiment 1, further comprising an EMOD ratio (EMOD1/EMOD2), wherein EMOD1 represents an EMOD of the first abrasive portion and EMOD2 represents an EMOD of the second abrasive portion, wherein the EMOD ratio (EMOD1/EMOD2) is at least 1 or at least 1.1 or at least 1.2 or at least 1.5 or at least 2 or at least 3 or at least 4 or at least 5 or at least 8 or at least 10 or at least 20 or at least 50 or at least 100.

Embodiment 15. The abrasive article of embodiment 14, wherein the EMOD ratio (EMOD1/EMOD2) is not greater than 500 or not greater than 400 or not greater than 300 or not greater than 200 or not greater than 100 or not greater than 75 or not greater than 50.

Embodiment 16. The abrasive article of embodiment 1, further comprising an EMOD ratio (EMOD1/EMODi), wherein EMOD1 represents an EMOD of the first abrasive portion and EMODi represents an EMOD of the interior portion, wherein the EMOD ratio (EMOD1/EMODi) is at least 1 or at least 1.1 or at least 1.2 or at least 1.5 or at least 2 or at least 3 or at least 4 or at least 5 or at least 8 or at least 10 or at least 20 or at least 50 or at least 100.

Embodiment 17. The abrasive article of embodiment 16, wherein the EMOD ratio (EMOD1/EMODi) is not greater than 500 or not greater than 400 or not greater than 300 or not greater than 200 or not greater than 100 or not greater than 75 or not greater than 50.

Embodiment 18. The abrasive article of embodiment 1, wherein the first abrasive portion comprises an EMOD within a range of at least 0.9 GPa and not greater than 100 GPa.

Embodiment 19. The abrasive article of embodiment 1, wherein the second abrasive portion comprises an EMOD within a range of at least 0.5 GPa and not greater than 100 GPa.

Embodiment 20. The abrasive article of embodiment 1, wherein the interior portion comprises an EMOD within a range of at least 0.5 GPa and not greater than 100 GPa.

Embodiment 21. The abrasive article of embodiment 1, wherein the bond material of the second abrasive portion is different than the bond material of the interior portion.

Embodiment 22. The abrasive article of embodiment 1, wherein the bond material of the second abrasive portion is the same as the bond material of the interior portion.

Embodiment 23. The abrasive article of embodiment 1, wherein the interior portion comprises a length extending along a longitudinal axis of the body that defines a length of the body, and the length of the interior portion extends for an entire length of the body.

Embodiment 24. The abrasive article of embodiment 1, wherein the body comprises a length and the first abrasive portion comprises a length, wherein the length of the first abrasive portion extends for a portion of a total length of the body.

Embodiment 25. The abrasive article of embodiment 1, wherein the body comprises a length and the second abrasive portion comprises a length, wherein the length of the first abrasive portion extends for a portion of a total length of the body.

Embodiment 26. The abrasive article of embodiment 1, wherein the first abrasive portion comprises abrasive particles having an average particle size greater than an average particle size of the abrasive particles contained within the second abrasive portion.

Embodiment 27. The abrasive article of embodiment 1, wherein the interior portion comprises abrasive particles contained within the bond material.

Embodiment 28. The abrasive article of embodiment 1, wherein the interior portion is essentially free of abrasive particles.

Embodiment 29. The abrasive article of embodiment 27, wherein the abrasive particles contained within the bond material of the interior portion are the same abrasive particles contained within the second abrasive portion.

Embodiment 30. The abrasive article of embodiment 1, further comprising an abrasive particle ratio (AP1/AP2), wherein AP1 represents the average particle size of the abrasive particles of the first abrasive portion and AP2 represents an average particle size of the abrasive particles of the second abrasive portion, wherein the abrasive particle ratio is at least 1.

Embodiment 31. The abrasive article of embodiment 30, wherein the abrasive particle ratio (AP1/AP2) is at least 1.1 or at least 1.2 or at least 1.3 or at least 1.5 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or at least 10 or at least 11 or at least 12 or at least 15.

Embodiment 32. The abrasive article of embodiment 30, wherein the abrasive particle ratio (AP1/AP2) is not greater than 50 or not greater than 40 or not greater than 30 or not greater than 20 or not greater than 18 or not greater than 15 or not greater than 12.

Embodiment 33. The abrasive article of embodiment 1, wherein the abrasive particles of the first abrasive portion include at least one material selected from the group of carbides, nitrides, borides, oxides, superabrasives, or any combination thereof.

Embodiment 34. The abrasive article of embodiment 1, wherein at least a portion of the abrasive particles of the first abrasive portion comprise shaped abrasive particles.

Embodiment 35. The abrasive article of embodiment 1, wherein the abrasive particles of the first abrasive portion include a blend of different types of abrasive particles including shaped abrasive particles and non-shaped abrasive particle.

Embodiment 36. The abrasive article of embodiment 1, wherein the abrasive particles of the first abrasive portion comprise alumina.

Embodiment 37. The abrasive article of embodiment 1, wherein the abrasive particles of the first abrasive portion are present in a content of at least 5 vol % for a total volume of the first abrasive portion or at least 10 vol % or at least 15 vol % or at least 20 vol % or at least 25 vol % or at least 30 vol % or at least 35 vol %.

Embodiment 38. The abrasive article of embodiment 1, wherein the first abrasive portion comprises not greater than 70 vol % abrasive particles for the total volume of the first abrasive portion or not greater than 65 vol % or not greater than 60 vol % or not greater than 55 vol % or not greater than 50 vol % or not greater than 45 vol % or not greater than 40 vol % or not greater than 35 vol % or not greater than 30 vol %.

Embodiment 39. The abrasive article of embodiment 1, wherein the first abrasive portion comprises at least 2 vol % bond material for a total volume of the first abrasive portion or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol %.

Embodiment 40. The abrasive article of embodiment 1, wherein the first abrasive portion comprises not greater than 60 vol % bond material for the total volume of the first abrasive portion or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %.

Embodiment 41. The abrasive article of embodiment 1, wherein the first abrasive portion comprises at least 1 vol % porosity for a total volume of the first abrasive portion or at least 5 vol % or at least 10 vol % or at least 15 vol % or at least 20 vol % or at least 25 vol % or at least 30 vol % or at least 35 vol % or at least 40 vol % or at least 45 vol % or at least 50 vol % or at least 55 vol %.

Embodiment 42. The abrasive article of embodiment 1, wherein the first abrasive portion comprises not greater than 85 vol % porosity for the total volume of the first abrasive portion or not greater than 80 vol % or not greater than 70 vol % or not greater than 60 vol % or not greater than 55 vol % or not greater than 50 vol % or not greater than 45 vol % or not greater than 40 vol % or not greater than 30 vol %

Embodiment 43. The abrasive article of embodiment 1, wherein the first abrasive portion further comprises at least one filler material selected from the group of metals, ceramics, vitreous materials, polymers, needle-shaped materials, flakes, granular-shaped materials, fibrous materials, or any combination thereof.

Embodiment 44. The abrasive article of embodiment 43, wherein the filler material includes at least one of chopped strand fibers, glass fibers, mineral wool, a metal fiber, a ceramic fiber, a carbon fiber, a aramid fiber, wollastonite, frit, talc, mica, montmorillonite, clay, a pore former, hollow particles, grinding aids, defoamers, or any combination thereof.

Embodiment 45. The abrasive article of embodiment 43, wherein the first abrasive portion comprises at least 1 vol % filler for a total volume of the first abrasive portion or at least 2 vol % or at least 3 vol % or at least 4 vol % or at least 5 vol % or at least 6 vol % or at least 7 vol % or at least 8 vol % or at least 9 vol % or at least 10 vol % or at least 12 vol %.

Embodiment 46. The abrasive article of embodiment 43, wherein the first abrasive portion comprises not greater than 30 vol % filler for a total volume of the first abrasive portion or not greater than 25 vol % or not greater than 20 vol % or not greater than 18 vol % or not greater than 15 vol % or not greater than 10 vol % or not greater than 8 vol % or not greater than 6 vol % or not greater than 5 vol % or not greater than 4 vol % or not greater than 3 vol % or not greater than 2 vol %.

Embodiment 47. The abrasive article of embodiment 1, wherein the abrasive particles of the second abrasive portion include at least one material selected from the group of carbides, nitrides, borides, oxides, superabrasives, or any combination thereof.

Embodiment 48. The abrasive article of embodiment 1, wherein at least a portion of the abrasive particles of the second abrasive portion comprise shaped abrasive particles.

Embodiment 49. The abrasive article of embodiment 1, wherein the abrasive particles of the second abrasive portion include a blend of different types of abrasive particles including shaped abrasive particles and non-shaped abrasive particles.

Embodiment 50. The abrasive article of embodiment 1, wherein the abrasive particles of the second abrasive portion comprise alumina.

Embodiment 51. The abrasive article of embodiment 1, wherein the abrasive particles of the second abrasive portion are present in a content of at least 5 vol % for a total volume of the second abrasive portion or at least 10 vol % or at least 15 vol % or at least 20 vol % or at least 25 vol % or at least 30 vol % or at least 35 vol %.

Embodiment 52. The abrasive article of embodiment 1, wherein the second abrasive portion comprises not greater than 90 vol % abrasive particles for the total volume of the second abrasive portion or not greater than 80 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %.

Embodiment 53. The abrasive article of embodiment 1, wherein the second abrasive portion comprises at least 2 vol % bond material for a total volume of the second abrasive portion or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol %.

Embodiment 54. The abrasive article of embodiment 1, wherein the second abrasive portion comprises not greater than 80 vol % bond material for the total volume of the second abrasive portion or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol %.

Embodiment 55. The abrasive article of embodiment 1, wherein the second abrasive portion comprises at least 1 vol % porosity for a total volume of the second abrasive portion or at least 5 vol % or at least 10 vol % or at least 15 vol % or at least 20 vol % or at least 25 vol % or at least 30 vol % or at least 35 vol %

Embodiment 56. The abrasive article of embodiment 1, wherein the second abrasive portion comprises not greater than 55 vol % porosity for the total volume of the second abrasive portion or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 2 vol %.

Embodiment 57. The abrasive article of embodiment 1, wherein the second abrasive portion is essentially free of porosity.

Embodiment 58. The abrasive article of embodiment 1, wherein the second abrasive portion further comprises at least one filler material selected from the group of metals, ceramics, vitreous materials, polymers, needle-shaped materials, flakes, granular-shaped materials, fibrous materials, or any combination thereof.

Embodiment 59. The abrasive article of embodiment 58, wherein the filler material includes at least one of chopped strand fibers, glass fibers, mineral wool, a metal fiber, a ceramic fiber, a carbon fiber, a aramid fiber, wollastonite, frit, talc, mica, montmorillonite, clay, a pore former, hollow particles, grinding aids, defoamers, or any combination thereof.

Embodiment 60. The abrasive article of embodiment 58, wherein the second abrasive portion comprises at least 1 vol % filler for a total volume of the second abrasive portion or at least 2 vol % or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 20 vol % or at least 25 vol % or at least 30 vol % or at least 35 vol %.

Embodiment 61. The abrasive article of embodiment 58, wherein the second abrasive portion comprises not greater than 55 vol % filler for a total volume of the second abrasive portion or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 2 vol %.

Embodiment 62. The abrasive article of embodiment 1, wherein the second abrasive portion is essentially free of filler.

Embodiment 63. The abrasive article of embodiment 1, wherein the interior portion comprises abrasive particles or filler material contained within a bond material.

Embodiment 64. The abrasive article of embodiment 63, wherein the abrasive particles of the interior portion include at least one material selected from the group of carbides, nitrides, borides, oxides, superabrasives, or any combination thereof.

Embodiment 65. The abrasive article of embodiment 63, wherein at least a portion of the abrasive particles of the interior portion comprise shaped abrasive particles.

Embodiment 66. The abrasive article of embodiment 63, wherein the abrasive particles of the interior portion include a blend of different types of abrasive particles including shaped abrasive particles and non-shaped abrasive particles.

Embodiment 67. The abrasive article of embodiment 63, wherein the abrasive particles of the interior portion comprise alumina.

Embodiment 68. The abrasive article of embodiment 63, wherein the abrasive particles of the interior portion are present in a content of at least 5 vol % for a total volume of the interior portion or at least 10 vol % or at least 15 vol % or at least 20 vol % or at least 25 vol % or at least 30 vol % or at least 35 vol %.

Embodiment 69. The abrasive article of embodiment 63, wherein the interior portion comprises not greater than 80 vol % abrasive particles for the total volume of the interior portion or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %.

Embodiment 70. The abrasive article of embodiment 63, wherein the interior portion is free of abrasive particles.

Embodiment 71. The abrasive article of embodiment 63, wherein the interior portion is free of abrasive particles and includes at least one filler material contained within the bond material.

Embodiment 72. The abrasive article of embodiment 63, wherein the interior portion comprises at least 2 vol % bond material for a total volume of the interior portion or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 18 vol % or at least 20 vol % or at least 25 vol % or at least 30 vol % or at least 35 vol % or at least 40 vol % or at least 45 vol % or at least 55 vol % or at least 60 vol % or at least 65 vol % or at least 70 vol % or at least 75 vol % or at least 80 vol % or at least 85 vol % or at least 90 vol % or at least 95 vol % or at least 99 vol %.

Embodiment 73. The abrasive article of embodiment 63, wherein the interior portion comprises not greater than 99.99 vol % bond material for the total volume of the interior portion or not greater than 95 vol % or not greater than 90 vol % or not greater than 85 vol % or not greater than 80 vol % or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol %.

Embodiment 74. The abrasive article of embodiment 63, wherein the interior portion comprises at least 1 vol % porosity for a total volume of the interior portion or at least 5 vol % or at least 10 vol % or at least 15 vol % or at least 20 vol % or at least 25 vol % or at least 30 vol %

Embodiment 75. The abrasive article of embodiment 63, wherein the interior portion comprises not greater than 50 vol % porosity for the total volume of the interior portion or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 3 vol % or not greater than 1 vol %.

Embodiment 76. The abrasive article of embodiment 63, wherein the interior portion is essentially free of porosity.

Embodiment 77. The abrasive article of embodiment 63, wherein the interior portion comprises at least one filler material selected from the group of metals, ceramics, vitreous materials, polymers, needle-shaped materials, flakes, granular-shaped materials, fibrous materials, or any combination thereof.

Embodiment 78. The abrasive article of embodiment 77, wherein the filler material includes at least one of chopped strand fibers, glass fibers, mineral wool, a metal fiber, a ceramic fiber, a carbon fiber, a aramid fiber, wollastonite, frit, talc, mica, montmorillonite, clay, a pore former, hollow particles, grinding aids, defoamers, or any combination thereof.

Embodiment 79. The abrasive article of embodiment 77, wherein the interior portion comprises at least one filler material and is free of abrasive particles.

Embodiment 80. The abrasive article of embodiment 63, wherein the interior portion comprises at least 1 vol % filler for a total volume of the interior portion or at least 2 vol % or at least 3 vol % or at least 4 vol % or at least 5 vol % or at least 6 vol % or at least 7 vol % or at least 8 vol % or at least 9 vol % or at least 10 vol % or at least 12 vol % or at least 15 vol % or at least 20 vol % or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol %.

Embodiment 81. The abrasive article of embodiment 63, wherein the interior portion comprises not greater than 80 vol % filler for a total volume of the interior portion or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 20 vol % or not greater than 15 vol % or not greater than 10 vol % or not greater than 8 vol % or not greater than 5 vol % or not greater than 3 vol % or not greater than 1 vol %.

Embodiment 82. The abrasive article of embodiment 1, wherein the interior portion is essentially free of abrasive particles and filler materials.

Embodiment 83. A method of making an abrasive article comprising: forming a first abrasive portion; forming a second abrasive portion; coupling the first abrasive portion to the second abrasive portion to form an abrasive sub-assembly; and forming an interior portion and coupling the abrasive sub-assembly to the interior portion.

Embodiment 84. The method of embodiment 83, wherein forming the first abrasive portion comprises forming a vitreous bonded abrasive portion.

Embodiment 85. The method of embodiment 83, wherein forming the first abrasive portion comprises: forming a green body comprising a frit material and abrasive particles; heat treating the green body at a temperature of at least 400° C. to form a vitreous bonded abrasive portion.

Embodiment 86. The method of embodiment 83, wherein the second abrasive portion is formed separately from the first abrasive portion.

Embodiment 87. The method of embodiment 83, wherein forming the second abrasive portion comprises forming an organic bonded abrasive portion.

Embodiment 88. The method of embodiment 83, wherein forming the second abrasive portion comprises: forming a mixture comprising a bond precursor comprising a polymer and abrasive particles; and curing the mixture to form an organic bonded abrasive portion.

Embodiment 89. The method of embodiment 83, wherein coupling the first abrasive portion to the second abrasive portion is conducted after forming the first abrasive portion and the second abrasive portion.

Embodiment 90. The method of embodiment 83, wherein coupling the first abrasive portion to the second abrasive portion comprises adhering the first abrasive portion to the second abrasive portion.

Embodiment 91. The method of embodiment 83, wherein forming the interior portion comprises integrally forming the interior portion on the first abrasive portion and the second abrasive portion simultaneously.

Embodiment 92. The method of embodiment 83, wherein forming the interior portion comprises: forming a mixture comprising a bond precursor comprising a polymer and abrasive particles or filler material; and curing the mixture to form an organic bonded abrasive portion.

Embodiment 93. The method of embodiment 83, wherein forming the interior portion comprises curing the material to the interior surfaces of the first abrasive portion and second abrasive portion simultaneously.

Embodiment 94. A method of making an abrasive article comprising: forming a first abrasive portion; forming a second abrasive portion having a flanged portion; and coupling the first abrasive portion to the second abrasive portion, wherein the first abrasive portion is adhered to the flanged portion of the second abrasive portion.

Embodiment 95. The method of embodiment 94, wherein forming the first abrasive portion comprises forming a vitreous bonded abrasive portion.

Embodiment 96. The method of embodiment 94, wherein forming the first abrasive portion comprises: forming a green body comprising a frit material and abrasive particles; heat treating the green body at a temperature of at least 400° C. to form a vitreous bonded abrasive portion.

Embodiment 97. The method of embodiment 94, wherein the second abrasive portion is formed separately from the first abrasive portion.

Embodiment 98. The method of embodiment 94, wherein forming the second abrasive portion comprises forming an organic bonded abrasive portion.

Embodiment 99. The method of embodiment 94, wherein forming the second abrasive portion comprises: forming a mixture comprising a bond precursor comprising a polymer and abrasive particles; and curing the mixture to form an organic bonded abrasive portion.

Embodiment 100. The method of embodiment 94, wherein coupling the first abrasive portion to the second abrasive portion is conducted after forming the first abrasive portion and the second abrasive portion.

Embodiment 101. The method of embodiment 94, wherein coupling includes casting the second abrasive portion directly to the first abrasive portion without an intervening layer between the second abrasive portion and the first abrasive portion.

Embodiment 102. The abrasive article of embodiment 1, wherein the second abrasive portion and the interior portion define a same monolithic portion.

EXAMPLES

Example 1

A vitrified wheel sample representative of the first abrasive portion of an embodiment was prepared. The wheel sample was available from Saint-Gobain and had a product number UPC 66253448402. The sample had a dimension of 220×110×130 mm. An organic bonded wheel sample representative of the second abrasive portion of an embodiment was prepared. The organic bonded wheel sample was available from Saint-Gobain and had a product number UPC 66253448411. The sample had a dimension of 220×70×130 mm.

The vitrified wheel sample was attached to the organic bonded wheel sample using a two-component epoxy adhesive having a dynamic viscosity of 200000 MPas, density of about 1.6 g/cm3, and a vapor pressure of 0.1 hPa at 20° C. The adhesive was allowed up to 24 hours to cure. The composite wheel was placed in a mold, both of which were centered with the aid of magnets.

A third mixture was formed and cast into the empty space between the composite wheel and mold. The third mixture was poured directly in the bottom of mold and caution was taken to avoid wetting side surfaces of the composite wheel and to finish pouring in a relatively short time period so that the bond material in the mixture could maintain a constant viscosity. The third mixture was allowed up to 12 hours to cure to form an abrasive article representative of an embodiment. The interior portion had a composition of a wheel having a product number UPC 66253448414 from Saint-Gobain and had the dimension of 200×180×127 mm.

Example 2

Interior mixtures were prepared by mixing the abrasive particles and a precursor bond material in different contents. The abrasive particles were cubic white alumina having an average particle size of 66 microns. The precursor bond material was prepared by mixing an epoxy resin with one or two hardeners. The epoxy resin and hardeners were commercially available from Bakelite® AG. The compositions of the mixtures are included in Table 1.

TABLE 1

| | | Interior Mixture 1 | Interior Mixture 2 | Interior Mixture 3 |
|---|---|---|---|---|
| Precursor bond material | Epoxy resin Bakelite ® EPR 167 | 16.89 wt % | 35.87 wt % | 32.26 wt % |
| | Hardener 1 Bakelite ® EP3055 | 9.11 wt % | 18.13 wt % | 8.18 wt % |
| | Hardener 2 Bakelite ® EP05903 | / | / | 5.45 wt % |
| Abrasive Particles | | 74 wt % | 46 wt % | 54 wt % |
| Total | | 100 wt % | 100 wt % | 100 wt % |

The interior mixtures were poured into molds and allowed to cure at room temperature. Interior mixture 1 was too viscous and difficult to cast, resulting in a cured product having low homogeneity. Interior mixture 2 had too low viscosity, and after casting, sedimentation of abrasive particles occurred quickly before curing, resulting in a layered, non-homogeneous product. Interior mixture 3 was casted and cured successfully, and a cured product with high homogeneity was formed.

Modulus of rupture (MOR) of cured products formed with mixtures 1 and 3 were tested using the 3-point bending test. 6 bars each having a dimension of 80 mm×22 mm×20 mm were cut out of each product. Each bar was placed on a testing machine commercially available from Zwick/Roell (item reference No. MPM UTS 20 K 04-377/92) with the two supporting pins spaced apart by 7 cm, and a loading force was applied to the middle of the bar by the loading pin. The cured product formed with mixture 1 had an average MOR of 44 MPa of the 6 bars, and the one formed with mixture 3 had an average MOR of 104 MPa.

The present embodiments represent a departure from the state of the art. Notably, embodiments herein are related to an abrasive article including a body that can withstand vibrations at higher frequencies caused by high operation speeds, and thus, can be expected to have extended service life compared to the abrasive tools in the art in applications of high speed grinding. The body can have a burst speed of at least 60 m/s, at least 90 m/s, or even higher, and thus, higher grinding efficiency can be expected when utilizing the abrasive articles of embodiments herein. Not wishing to be bound by any theory, the improved burst speed may be at least in part resulted from one or more of properties (e.g., viscosity) of the bond material, particular contents of the bond material and abrasive particles, the type and content of the filler material, and a particular EMOD of the interior portion. The interior portion provides a buffering effect to reduce vibrations of the body when operating at a high grinding speed, allowing the body to be more resistant to vibrations and reducing potential damages that could occur to the body. Furthermore, the abrasive article of this disclosure can include a plurality of abrasive portions that differ in average abrasive particle sizes to allow coarse and fine grinding to be completed in a single operation, which further improve grinding efficiency. The abrasive articles of embodiments can be utilized in various applications, particularly high grinding operations, such as gear grinding. The methods of embodiments herein may be used to form various desirable abrasive tools, and may be particularly suitable for forming abrasive articles having a relatively large dimension, such as a grinding wheel having a large outer diameter (e.g., 1350 mm), because larger abrasive tools tend to crack in high operation speeds.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present)

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive article comprising:

a body including:

an interior portion defining a central aperture of the body extending in an axial direction;

a first abrasive portion comprising first abrasive particles contained within a first bond material comprising a vitreous material, wherein the first abrasive particles comprise a first average particle size AP1; and a second abrasive portion comprising second abrasive particles contained within a second bond material, wherein the second abrasive particles comprise an oxide, a carbide, or a combination thereof, and wherein the second abrasive particles comprise a second average particle size AP2, wherein AP1>AP2, wherein:

the interior portion is coupled to the first abrasive portion and the second abrasive portion; and the second abrasive portion is coupled to the first abrasive portion in the axial direction.

2. The abrasive article of claim 1, wherein the central aperture extends through an entire length of the body extending in the axial direction, wherein the first abrasive portion comprises a length extending for a portion of the entire length of the body.

3. The abrasive article of claim 2, wherein the second portion comprises a length extending for another portion of the entire length of the body.

4. The abrasive article of claim 1, wherein the body comprises a length extending in the axial direction, wherein the interior portion comprises a length extending for an entire length of the body.

5. The abrasive article of claim 1, wherein the first abrasive portion is bonded directly to the second abrasive portion.

6. The abrasive article of claim 1, further comprising an adhesive between the first abrasive portion and the second abrasive portion.

7. The abrasive article of claim 1, wherein the interior portion comprises a bond material different than the second bond material.

8. The abrasive article of claim 1, wherein the interior portion comprises a bond material that is the same as the second bond material.

9. The abrasive article of claim 1, wherein the interior portion comprises at least one of:

a bond material comprising an organic material; and an elastic modulus (EMOD) within a range of at least 0.5 GPa and not greater than 100 GPa.

10. The abrasive article of claim 1, wherein the first abrasive particles comprise at least one material selected from the group of carbides, nitrides, borides, oxides, superabrasives, or any combination thereof.

11. The abrasive article of claim 1, wherein at least a portion of the first abrasive particles comprise shaped abrasive particles.

12. The abrasive article of claim 1, wherein the first abrasive particles include a blend of different types of abrasive particles including shaped abrasive particles and non-shaped abrasive particles.

13. The abrasive article of claim 1, wherein the first abrasive particles comprise alumina.

14. The abrasive article of claim 1, wherein the first abrasive portion comprises for a total volume of the first abrasive portion:

at least 10 vol % and not greater than 70 vol % of the first abrasive particles;

at least 2 vol % and not greater than 65 vol % of the first bond material; and at least 5 vol % and not greater than 80 vol % of porosity.

15. The abrasive article of claim 1, wherein the second abrasive portion comprises for a total volume of the second abrasive portion:

at least 5 vol % and not greater than 60 vol % of the second abrasive particles;

at least 2 vol % and not greater than 55 vol % of the second bond material; and at least 1 vol % and not greater than 55 vol % of porosity.

16. The abrasive article of claim 1, wherein the second abrasive portion comprises a filler material selected from the group of chopped strand fibers, glass fibers, mineral wool, a metal fiber, a ceramic fiber, a carbon fiber, an aramid fiber, wollastonite, frit, talc, mica, montmorillonite, clay, a pore former, hollow particles, grinding aids, defoamers, graphite, or any combination thereof.

17. The abrasive article of claim 16, wherein the filler material is present in a content of at least 1 vol % and not greater than 25 vol % for a total volume of the second abrasive portion.

18. The abrasive article of claim 1, wherein the second abrasive particles comprise alumina.

19. The abrasive article of claim 1, wherein at least a portion of the second abrasive particles comprise shaped abrasive particles.

20. The abrasive article of claim 1, wherein a ratio of AP1/AP2 is at least 1.5 and not greater than 50.

* * * * *